US010840593B1

(12) United States Patent
Johnson et al.

(10) Patent No.: US 10,840,593 B1
(45) Date of Patent: Nov. 17, 2020

(54) ANTENNA DEVICES TO SUPPRESS GROUND PLANE INTERFERENCE

(71) Applicants: Alexander Johnson, Miami, FL (US); Jingni Zhong, Miami, FL (US); Elias Alwan, Miami, FL (US); John L. Volakis, Miami, FL (US)

(72) Inventors: Alexander Johnson, Miami, FL (US); Jingni Zhong, Miami, FL (US); Elias Alwan, Miami, FL (US); John L. Volakis, Miami, FL (US)

(73) Assignee: The Florida International University Board of Trustees, Miami, FL (US)

( * ) Notice: Subject to any disclaimer, the term of this patent is extended or adjusted under 35 U.S.C. 154(b) by 0 days.

(21) Appl. No.: 16/782,740

(22) Filed: Feb. 5, 2020

(51) Int. Cl.

| | |
|---|---|
| ***H01Q 15/00*** | (2006.01) |
| ***H01Q 1/52*** | (2006.01) |
| ***H01Q 21/06*** | (2006.01) |
| ***H01Q 5/25*** | (2015.01) |
| ***H01Q 21/00*** | (2006.01) |

(52) U.S. Cl.
CPC ..... *H01Q 1/523* (2013.01); *H01Q 5/25* (2015.01); *H01Q 15/0013* (2013.01); *H01Q 21/0075* (2013.01); *H01Q 21/062* (2013.01)

(58) Field of Classification Search
CPC .. H01Q 1/523; H01Q 21/0075; H01Q 21/062; H01Q 5/25; H01Q 5/48; H01Q 9/285; H01Q 9/065; H01Q 9/16; H01Q 9/265; H01Q 15/0013; H01Q 19/108
See application file for complete search history.

(56) References Cited

U.S. PATENT DOCUMENTS

| | | | | |
|---|---|---|---|---|
| 6,512,494 | B1 * | 1/2003 | Diaz | H01Q 7/00 343/842 |
| 2014/0361946 | A1 * | 12/2014 | Ganchrow | H01Q 19/30 343/795 |
| 2016/0064831 | A1 * | 3/2016 | Jones, III | H01Q 21/26 343/798 |

OTHER PUBLICATIONS

Bah et al., A Wideband Low-Profile Tightly Coupled Antenna Array with a Very High Figure of Merit, IEEE Transactions on Antennas and Propagation, vol. 67, No. 4, Apr. 2010, pp. 2332-2343.
Bah et al., An Extremely Wideband Tapered Balun for Application in Tightly Coupled Arrays, IEEE-APS Topical Conference on Antennas and Propagation in Wireless Communications (APWC), Cairns, GLD, 2016, pp. 162-165.
Doane et al., A Wideband, Wide Scanning Tightly Coupled Dipole Array with Integrated Balun (TCDA-IB), IEEE Transactions on Antennas and Propagation, vol. 61, No. 9, Sep. 2013, pp. 4538-4548.
Farhat et al., Ultra-Wideband Tightly Coupled Phased Array Antenna for Low-Frequency Radio Telescope, PIERS Proceedings Stockholm, 2013, pp. 245-249.

(Continued)

*Primary Examiner* — Awat M Salih
(74) *Attorney, Agent, or Firm* — Saliwanchik, Lloyd & Eisenschenk

(57) ABSTRACT

Antenna devices that include a frequency selective surface (FSS) resistive card (R-card) to suppress ground plane interference are provided. The antenna device can include a tightly coupled dipole array (TCDA), and the FSS R-card can be a saw-tooth ring that only attenuates the intended frequencies. The antenna device can be an extremely wide-band phased array with integrated feeding network and spatial scanning down to 60°.

19 Claims, 22 Drawing Sheets

(56) References Cited

OTHER PUBLICATIONS

Maloney et al., Wide Scan, Integrated Printed Circuit Board, Fragmented Aperture Array Antennas, IEE International Symposium on Antennas and Propagation (APSURSI), Jul. 2011, pp. 1965-1968.

Moulder et al., Superstate-Enhanced Ultrawideband Tightly Coupled Array With Resistive FSS, IEEE Transactions on Antennas and Propagation, vol. 60, No. 9, Sep. 2012, pp. 4166-4172.

* cited by examiner

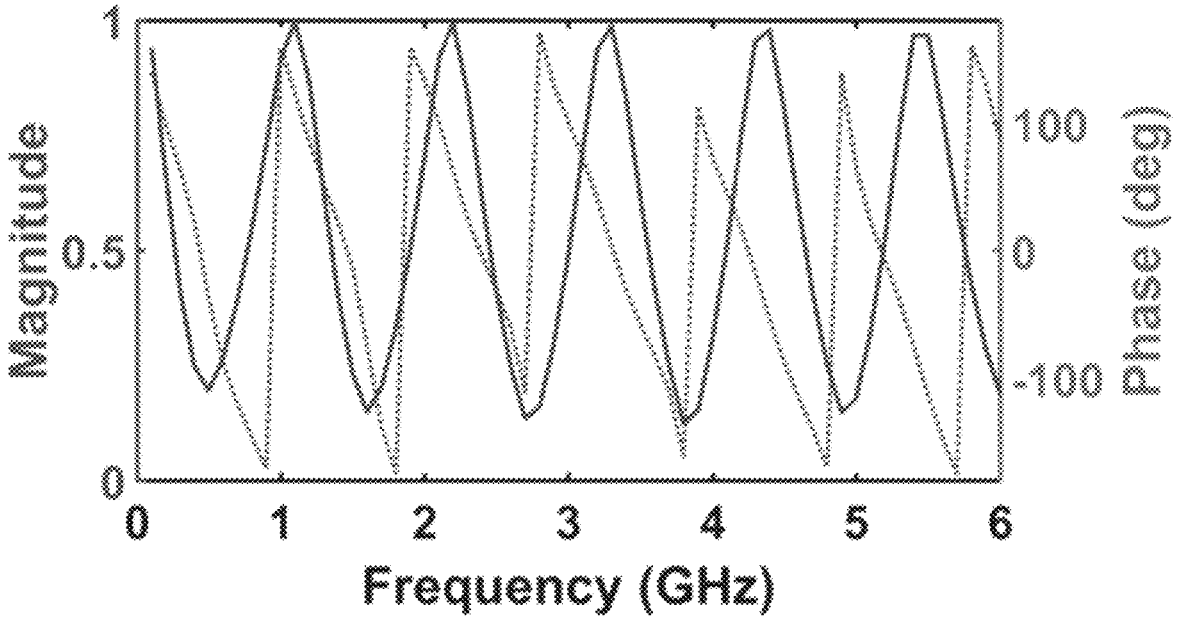
FIG. 3
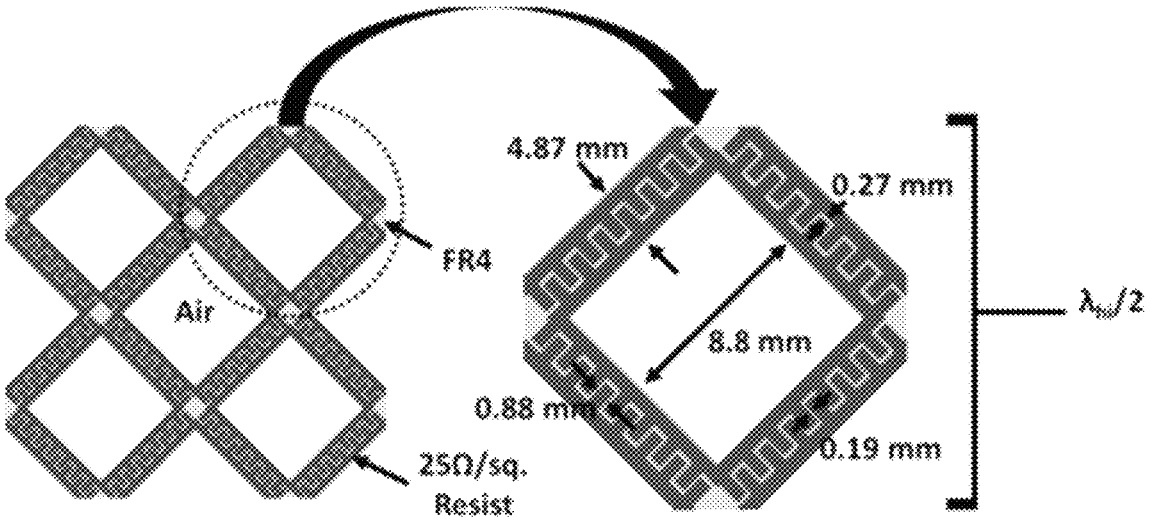
FIG. 4A
FIG. 4B

ANTENNA DEVICES TO SUPPRESS GROUND PLANE INTERFERENCE

BACKGROUND

Low profile wideband antennas and arrays are key components in a number of advanced communications and electronic warfare (EW) systems. For these systems, an ultra-wideband (UWB) array replaces several narrowband systems for orders of magnitude savings in power, cost, and space. They also enable increased data rates and secure spread spectrum communications. In addition to being wideband, these arrays must be low profile and operate across a wide scanning range for comprehensive spatial coverage from their designated platforms.

The most used UWB arrays are the connected and coupled arrays that have been considered since the early 2000s. A planar wideband connected slot array can have a 6-15 GHz design that can scan down to 60° in the H-plane and 80° in the E-plane. Similarly, a variation of the coupled dipole known as the planar ultra-wideband modular antenna (PUMA) array can have 6:1 impedance bandwidth with direct unbalanced 50Ω feeding.

Among low profile coupled and connected arrays, tightly coupled dipole antenna (TCDA) arrays have demonstrated the greatest impedance bandwidths and scanning performance in a low profile ($<\lambda_{Low}/12$ and bandwidth >6:1). These UWB arrays are an implementation of Wheeler's ideal current sheet array (CSA) concept (Wheeler, "Simple relations derived from a phased array made of an infinite current sheet," Antennas and Propagation Society International Symposium, vol. 2, September 1964, pp. 157-160). Early realizations of the CSA achieved 4:1 bandwidths by introducing inter-digital capacitance between antenna elements to counter the effect of ground plane inductance. The TCDA improved bandwidth by using overlapping dipole elements, with frequency scalability to millimeter waves (mm-waves). However, limitations still exist with respect to achieving wide bandwidth with small size and good scanning range.

BRIEF SUMMARY

Embodiments of the subject invention provide novel and advantageous antenna devices that include a frequency selective surface (FSS) resistive card (R-card) to suppress ground plane interference. The antenna device can include a tightly coupled dipole array (TCDA), and the FSS R-card can be, for example, a saw-tooth ring (see FIG. 4) that only attenuates the intended frequencies, thereby increasing total efficiency. The antenna device can be an extremely wideband phased array with integrated feeding network and good spatial scanning (e.g., spatial scanning down to 60°). The antenna device can have a bandwidth of at least 50:1 (e.g., 58:1) together with the scanning capability down to 60° in both E- and H-planes, and the radiation efficiency can be at least 70% (e.g., at least 72% or at least 73%). The FSS R-card can provide an extremely wideband (EWB) impedance match.

In an embodiment, an antenna device can comprise: a ground plane; a substrate disposed on the ground plane; a plurality of antenna elements disposed on the substrate; and an FSS R-card disposed between the ground plane and the plurality of antenna elements. The FSS R-card can be a ring-style FSS R-card with an air gap therewithin. The FSS R-card can be disposed in the substrate. The antenna device can further comprise a balun electrically connected to the plurality of antenna elements, and the balun can be a tapered stripline balun comprising an exponentially tapered stripline feed. The plurality of antenna elements can be a TCDA, and each element of the TCDA can have a width equal to $\lambda_{high}/2$, where $\lambda_{high}$ is a wavelength at a highest frequency of operation of the antenna device. The FSS R-card can be, for example, a saw-tooth ring FSS R-card comprising a grid of square rings (see FIG. 4). A diagonal length of each square ring can be equal to $\lambda_{high}/2$. The FSS R-card can be disposed horizontally such that the FSS R-card comprises an upper surface and a lower surface that are both parallel to an upper surface of the ground plane. A distance between the ground plane and a top portion of the plurality of antenna elements can be equal to $\lambda_{low}/13.5$, where $\lambda_{low}$ is a wavelength at a lowest frequency of operation of the antenna device. The plurality of antenna elements can comprise capacitive overlaps between adjacent antenna elements. The antenna device can comprise exactly one FSS R-card.

In another embodiment, an antenna device can comprise: a ground plane; a substrate disposed on the ground plane; a TCDA comprising a plurality of antenna elements disposed on the substrate; an FSS R-card disposed between the ground plane and the plurality of antenna elements; and a balun electrically connected to the plurality of antenna elements. The balun can be a tapered stripline balun comprising an exponentially tapered stripline feed.

BRIEF DESCRIPTION OF DRAWINGS

FIG. 1(*a*) shows a 4×4 array of a TCDA, which can either be the entire TCDA or in many cases a section of the entire TCDA. Although FIG. 1(*a*) indicates certain portions are made with specific materials, these are listed for exemplary purposes only and should not be construed as limiting.

FIG. 1(*b*) is a schematic view of a unit cell of the TCDA of FIG. 1(*a*), showing capacitive overlaps. Although FIG. 1(*b*) lists dimensions for certain portions, these are listed for exemplary purposes only and should not be construed as limiting.

FIG. 1(*c*) is a schematic view showing a close-up of the tapered balun stripline feed layers in FIG. 1(*b*).

FIG. 2(*b*) shows a schematic view of a TCDA with a 2-layer R-card.

FIG. 2(*c*) shows a schematic view of a TCDA with a 4-layer R-card.

FIG. 2(*d*) shows a schematic view of a TCDA with an FSS R-card according to an embodiment of the subject invention.

FIG. 3 is a plot of simulated $S_{11}$ magnitude (in decibels (dB)) and phase (in degrees) versus frequency (in gigahertz (GHz) of a plane wave reflected from an infinite ground plane in the presence of the FSS R-card depicted in FIG. 4. The dotted curve is for the phase, and the solid curve is for the magnitude.

FIG. 4(*a*) is an overhead view of a section of an FSS R-card, according to an embodiment of the subject invention. Although certain materials and values are listed in FIG. 4(*a*), these are listed for exemplary purposes only and should not be construed as limiting.

FIG. 4(*b*) is an overhead view showing an enlarged version of a portion of the FSS R-card shown in FIG. 4(*a*).

Although certain dimensions are listed in FIG. 4(*b*), these are listed for exemplary purposes only and should not be construed as limiting.

Figures 5A, 5B, 5C:
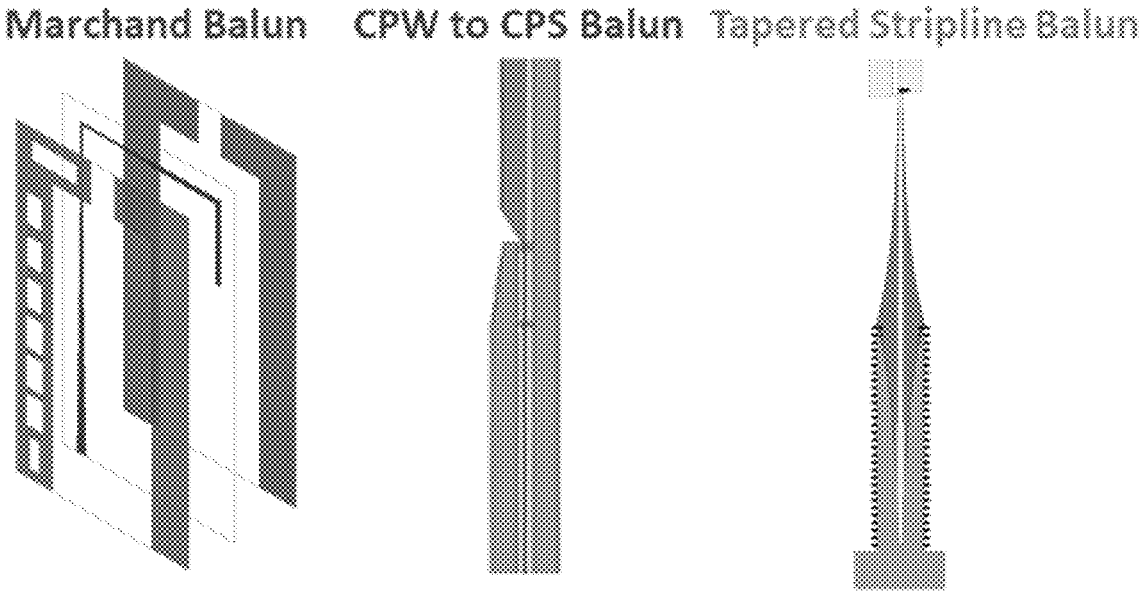
Figure 5D:
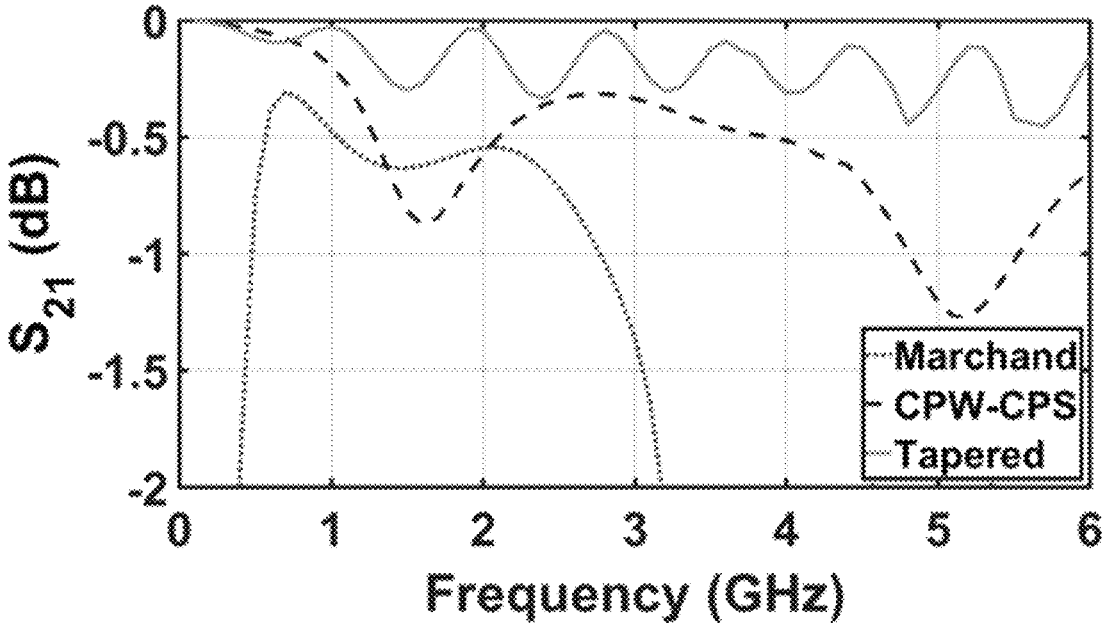

FIG. 5(*a*) is a schematic view of a Marchand balun.

FIG. 5(*b*) is a side view of a co-planar waveguide (CPW) to co-planar stripline (CPS) balun.

FIG. 5(*c*) is a side view of a tapered stripline balun.

FIG. 5(*d*) is a plot of S21 (in dB) versus frequency (GHz) comparing insertion loss for the baluns of FIGS. 5(*a*)-5(*c*). The dotted curve is for the Marchand balun (FIG. 5(*a*)); the dashed curve is for CPW-CPS balun (FIG. 5(*b*)); and the solid curve is for the tapered stripline balun (FIG. 5(*c*)).

Figures 1A, 1B, 1C:
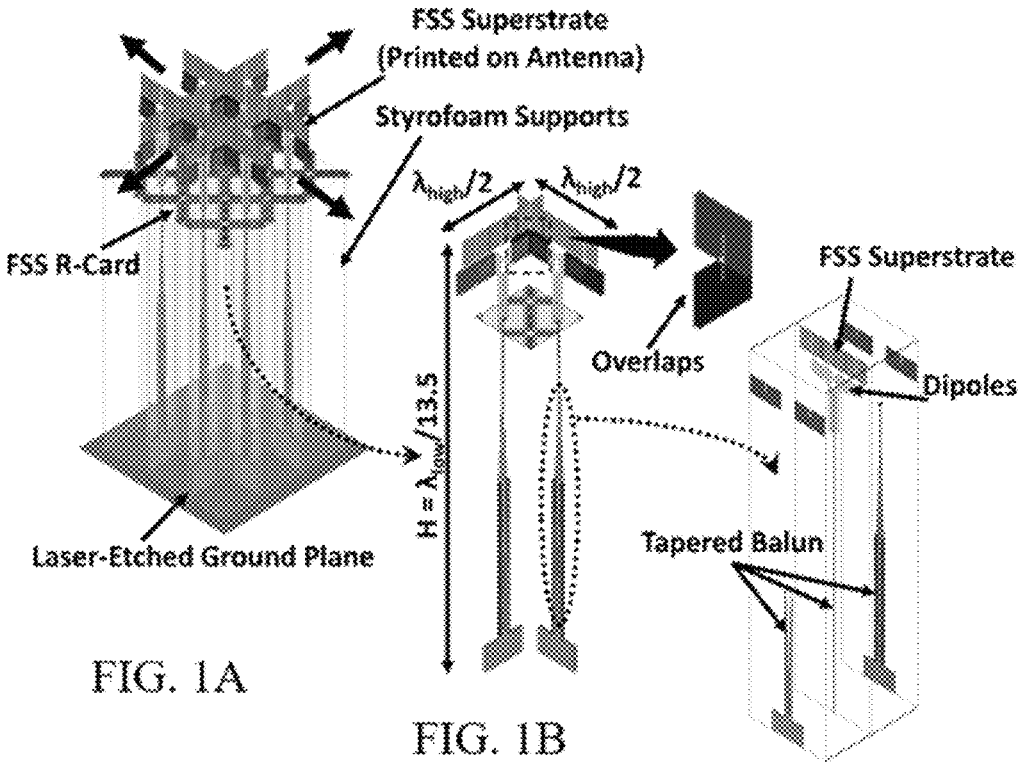
FIG. 1(*a*) is a schematic view of a tightly coupled dipole array (TCDA) with a frequency selective surface (FSS) resistive card (R-card), according to an embodiment of the subject invention.
Figure 6:
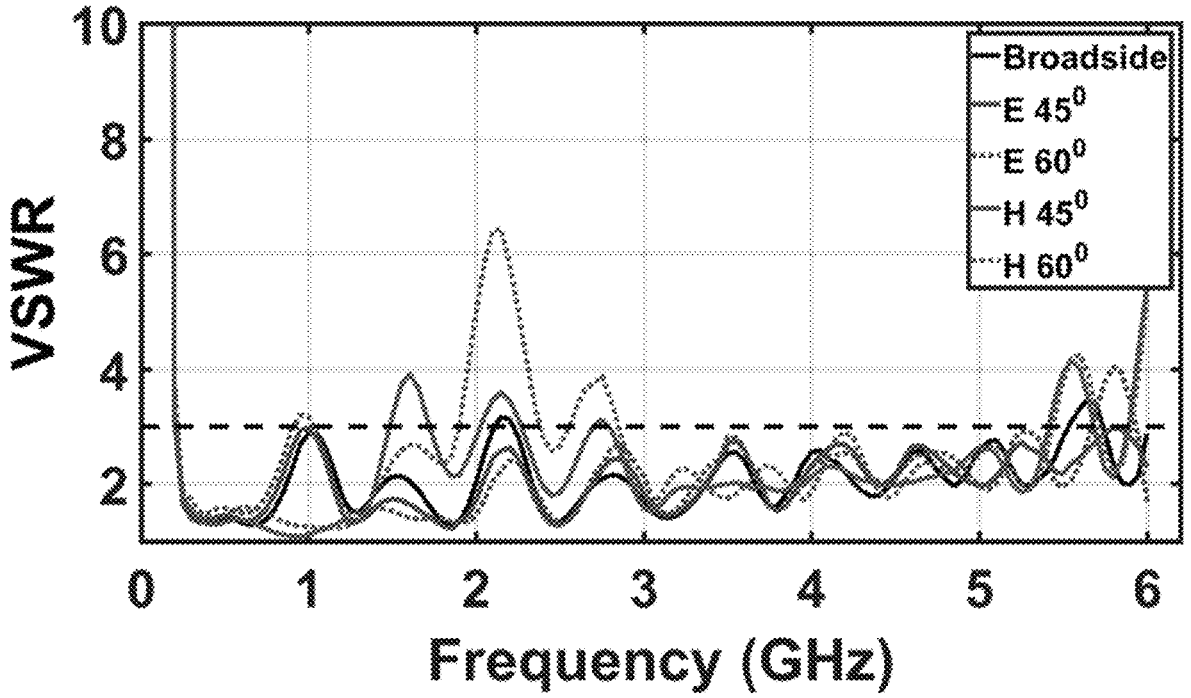

FIG. 6 is a plot of simulated voltage standing wave ratio (VSWR) versus frequency (in GHz), in principle planes (E/H) with scanning down to 60° from broadside, for an infinite array simulation of the TCDA depicted in FIGS. 1(*a*)-1(*c*).

Figure 7:
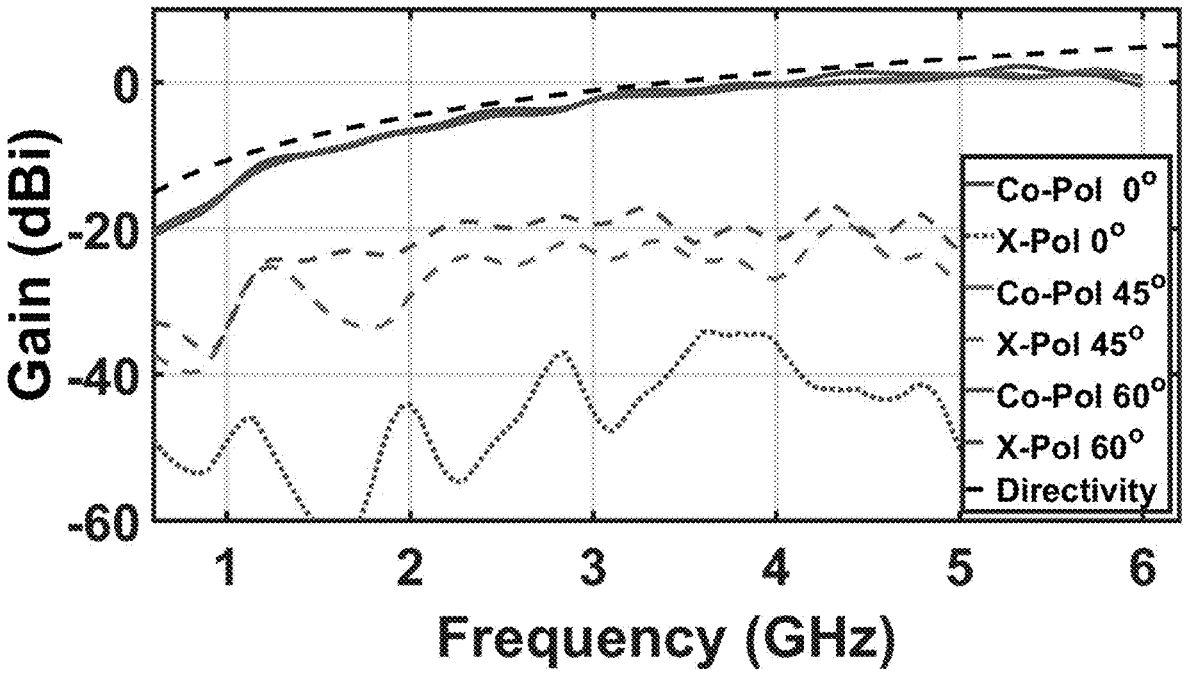

FIG. 7 is a plot of realized gain (in decibels relative to isotropic radiator (dBi)) versus frequency (in GHz), in principle planes (E/H) with scanning down to 60° from broadside, for a simulated unit cell of an infinite array simulation of the TCDA depicted in FIGS. 1(*a*)-1(*c*).

Figure 8:
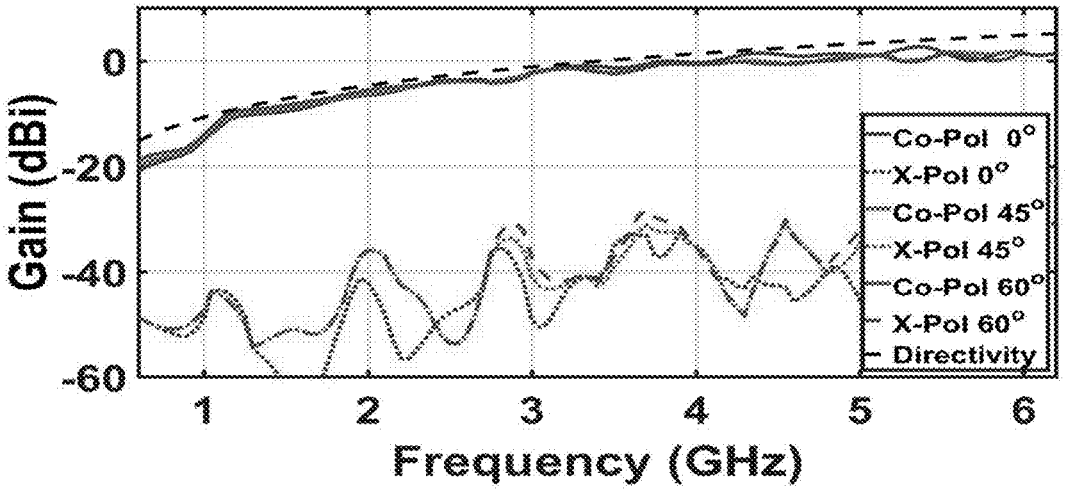

FIG. 8 is a plot of realized gain (in dBi) versus frequency (in GHz), in D-plane with scanning down to 60° from broadside, for a simulated unit cell of an infinite array simulation of the TCDA depicted in FIGS. 1(*a*)-1(*c*).

Figure 9:
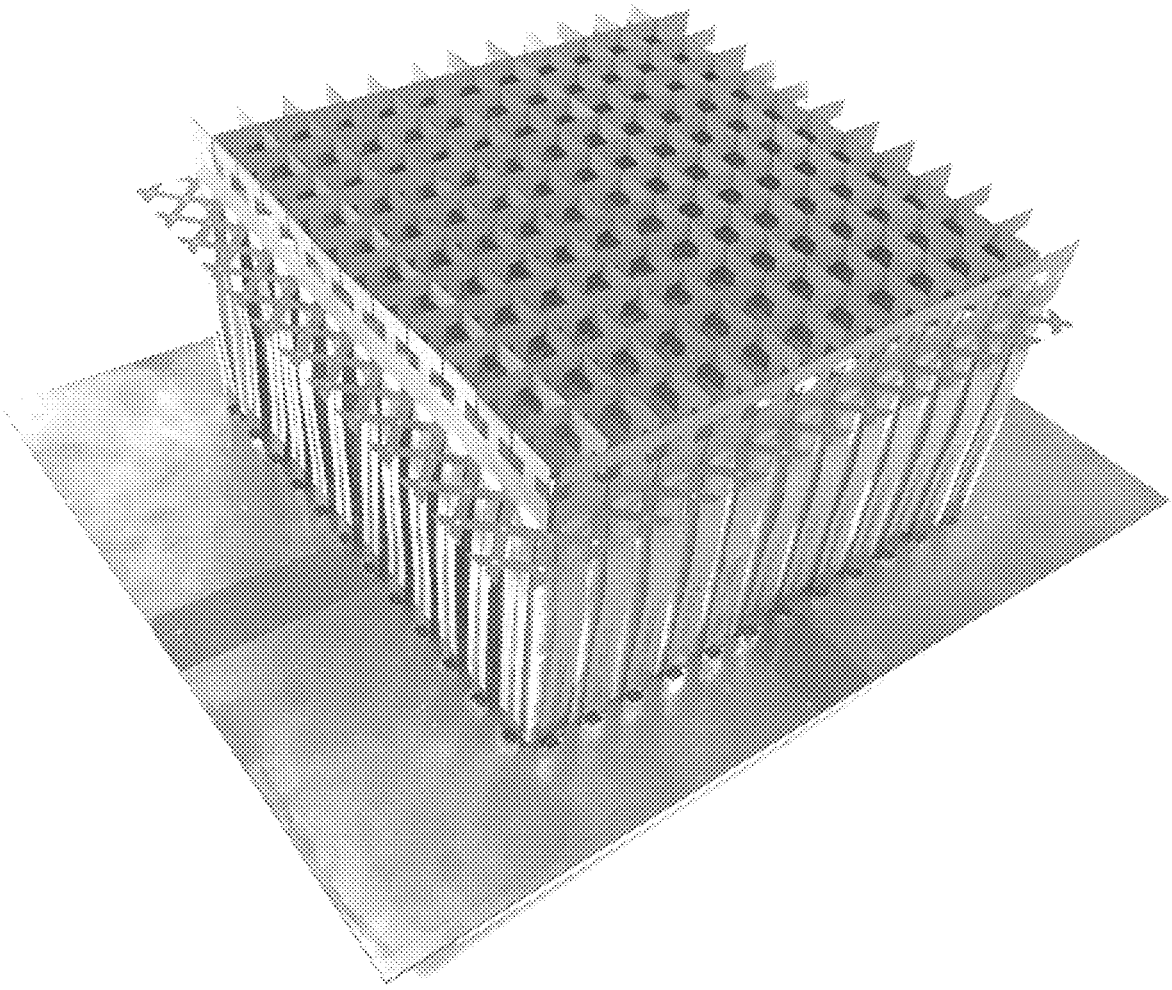

FIG. 9 is an image of a fabricated 12×12 array TCDA, according to an embodiment of the subject invention.

Figure 10A:
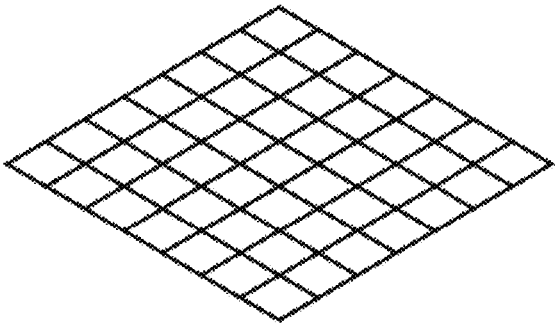
Figure 10B:
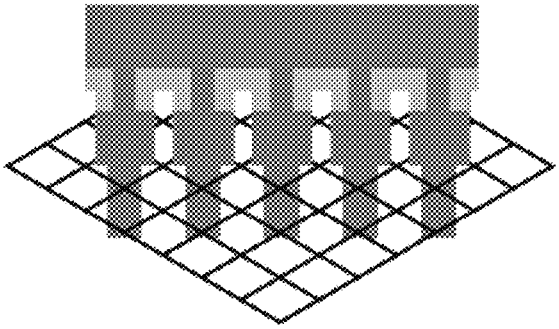

FIG. 10(*a*) is an image of an FSS R-card, according to an embodiment of the subject invention.

FIG. 10(*b*) is an image showing antenna cards inserted into the FSS R-card of FIG. 10(*a*).

Figure 11:
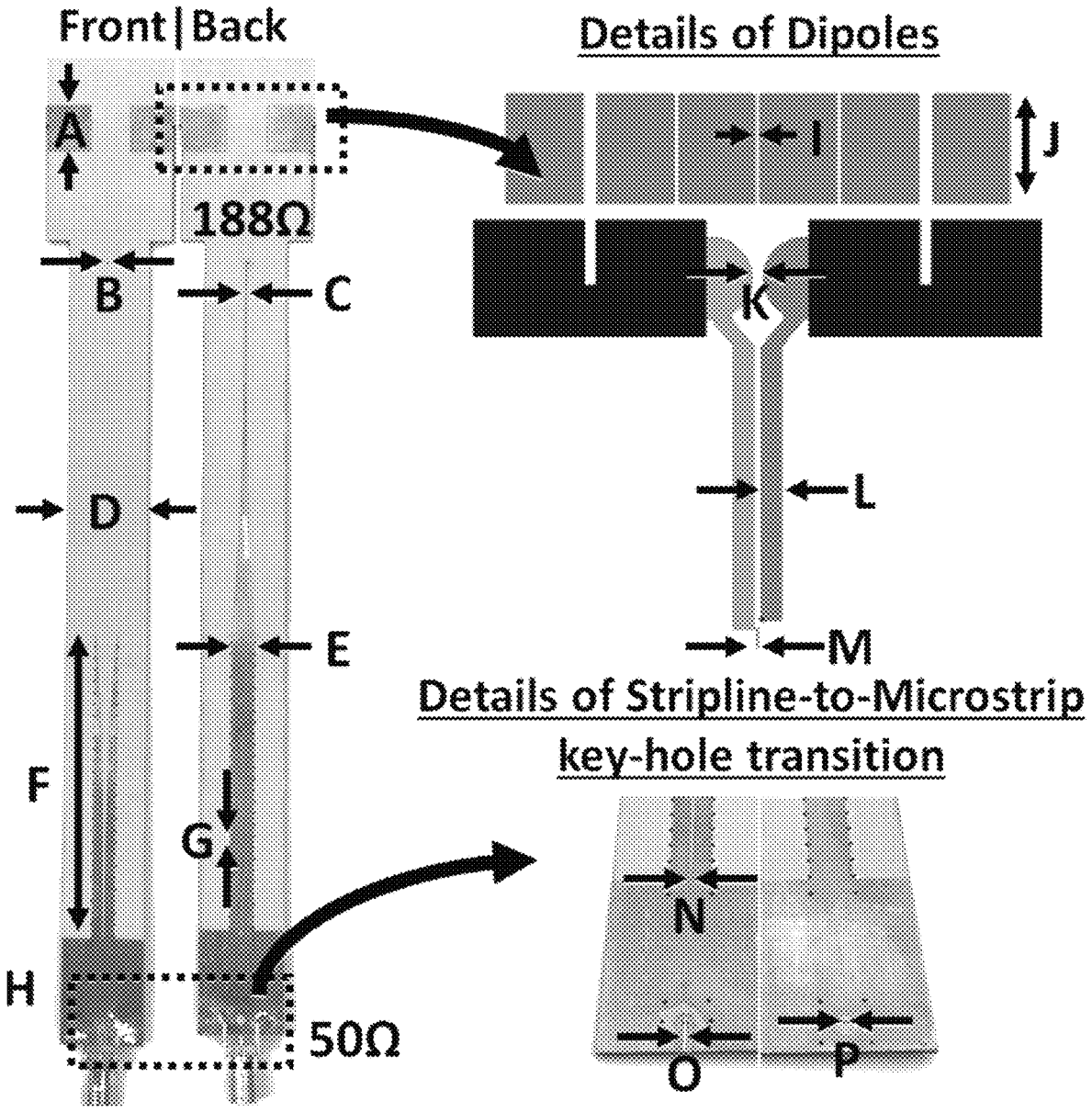

FIG. 11 shows an image of a tapered balun used to excite tightly coupled dipoles of a TCDA, according to an embodiment of the subject invention.

Figure 12A:
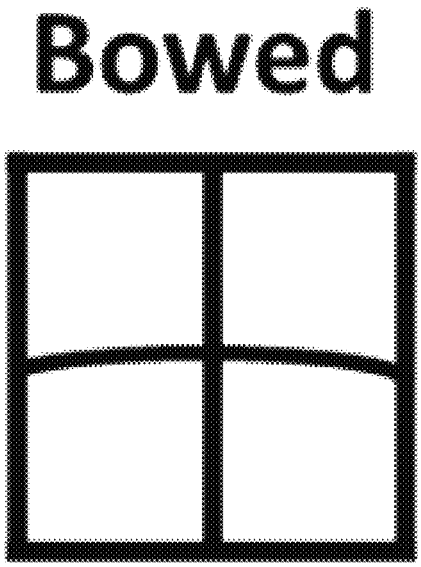
Figure 12B:
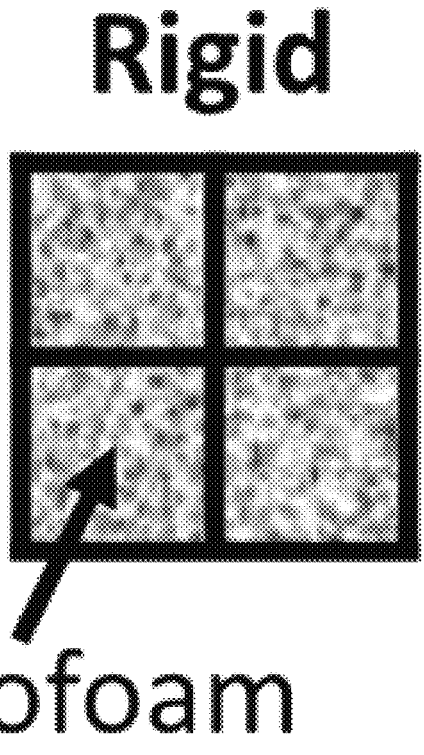

FIG. 12(*a*) shows an image of antenna cards with bowed feeds.

FIG. 12(*b*) shows an image of antenna cards with supports to inhibit bowing. Though Styrofoam supports are depicted in FIG. 12(*b*), this is for exemplary purposes only and should not be construed as limiting; other suitable materials can be used for support(s).

Figure 13:
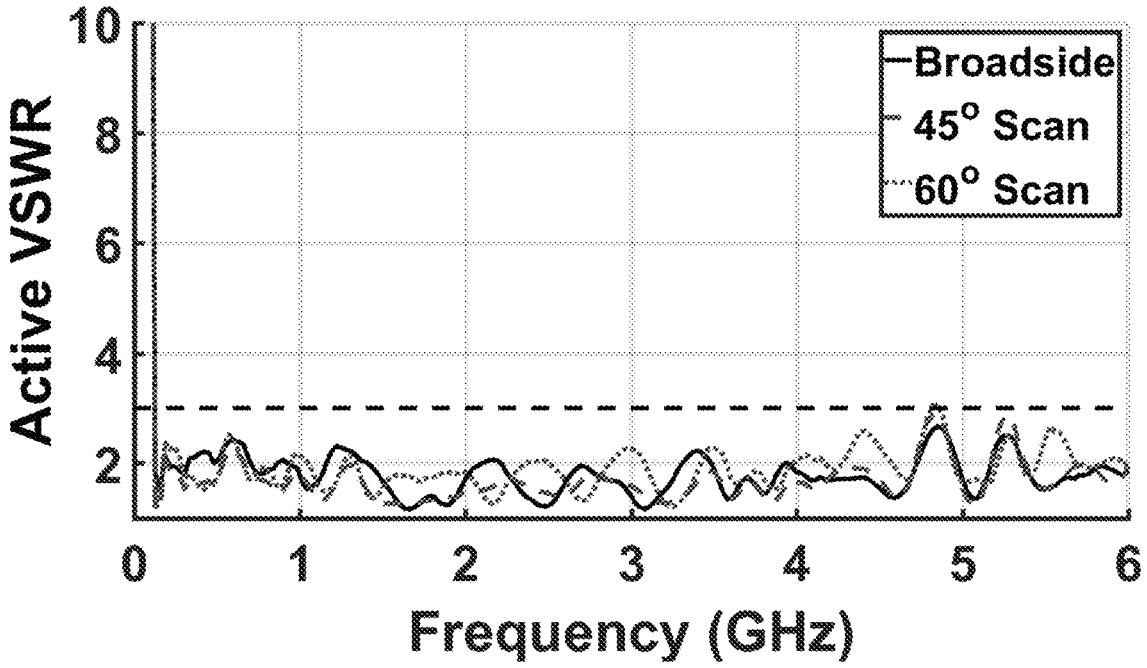

FIG. 13 is a plot of active VSWR versus frequency (in GHz), measured for E-plane of the center array element of the TCDA depicted in FIG. 9, with scanning to 45° and 60° from broadside. The solid curve is for broadside; the dashed curve is for 45° scan; and the dotted curve is for 60° scan.

Figure 14:
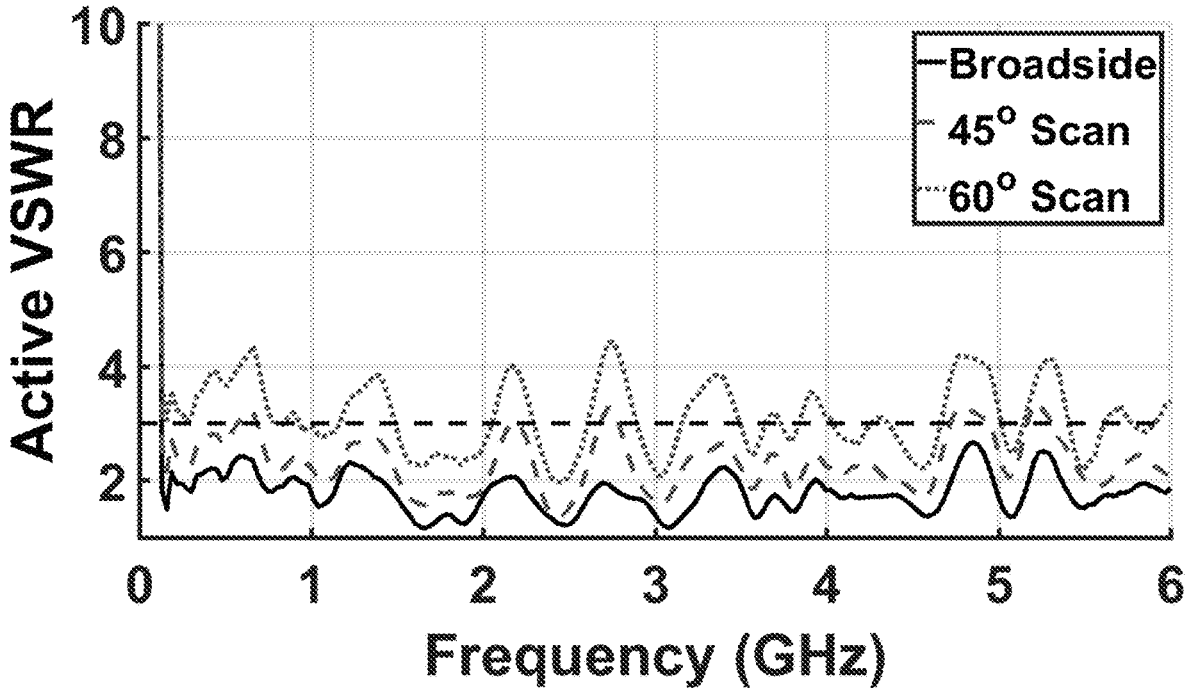

FIG. 14 is a plot of active VSWR versus frequency (in GHz), measured for H-plane of the center array element of the TCDA depicted in FIG. 9, with scanning to 45° and 60° from broadside. The solid curve is for broadside; the dashed curve is for 45° scan; and the dotted curve is for 60° scan.

Figure 15:
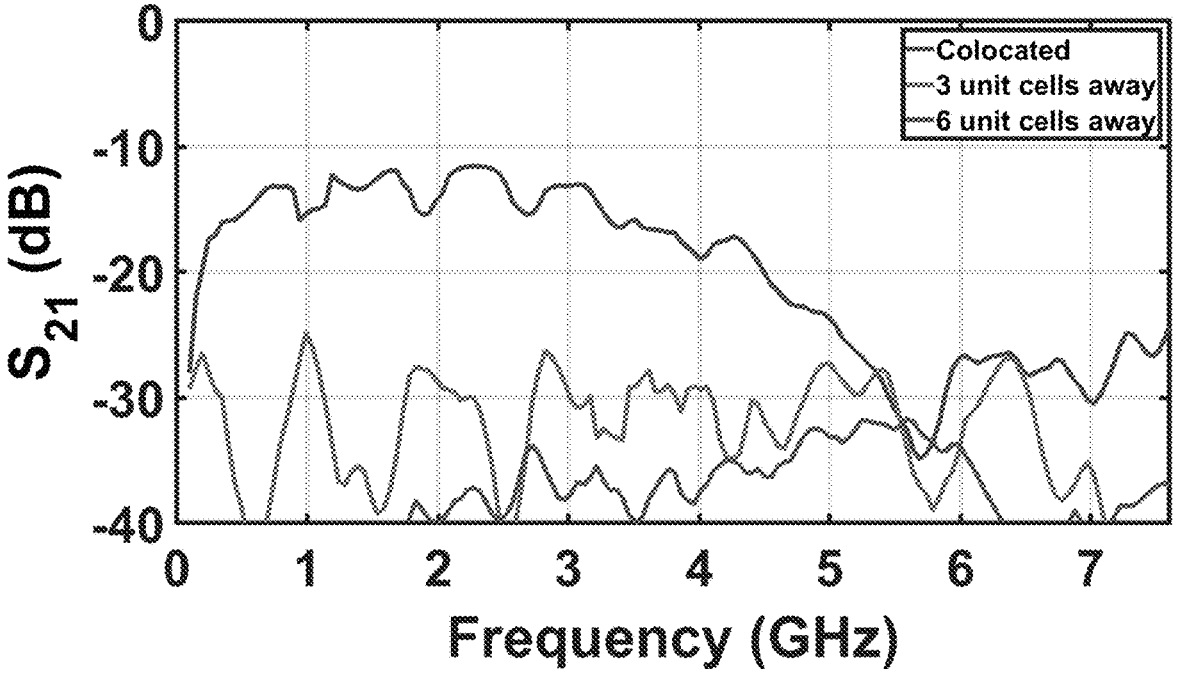

FIG. 15 is a plot of $S_{21}$ (in dB) versus frequency (in GHz), measuring coupling of the center array element to other array elements for the TCDA depicted in FIG. 9, at various distances. The curve that is the highest at 2 GHz is for collocated; the curve that is second-highest at 2 GHz is for 3 unit cells away; and the curve that is lowest at 2 GHz is for 6 unit cells away.

Figure 16:
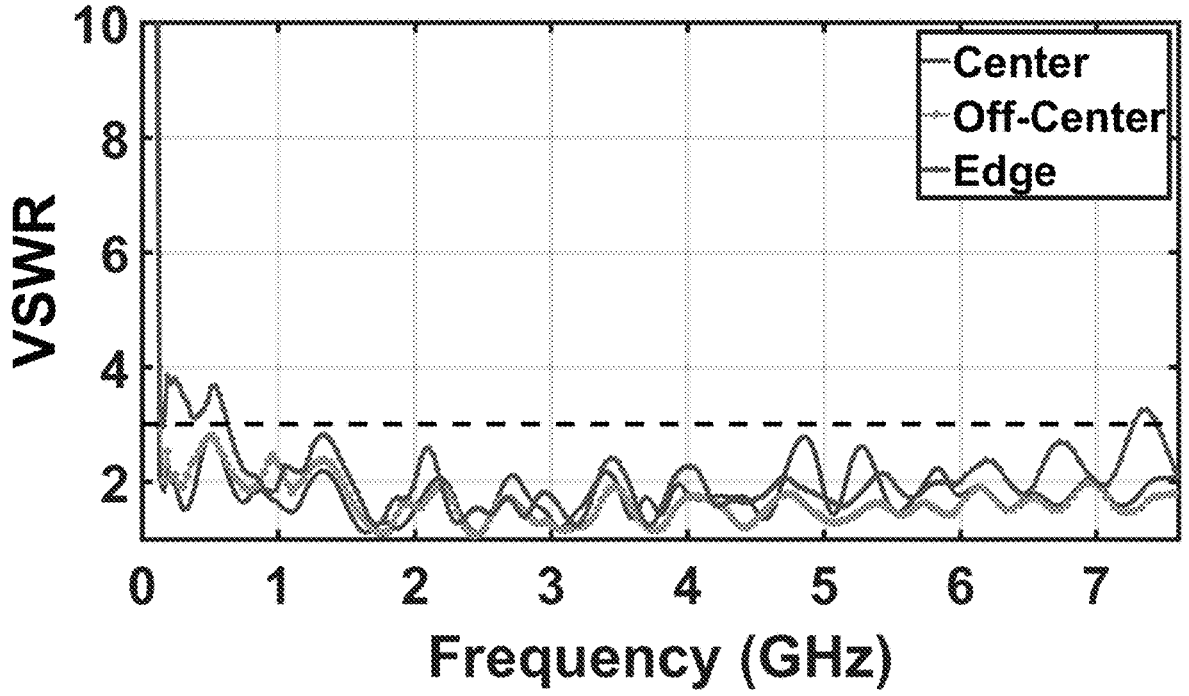

FIG. 16 is a plot of measured broadside active VSWR versus frequency (in GHz) of the center, off-center, and edge array elements of the TCDA depicted in FIG. 9. The curve that is the highest at 7.5 GHz is for edge; the curve that is second-highest at 7.5 GHz is for center; and the curve that is lowest at 7.5 GHz is for off-center.

Figure 17:
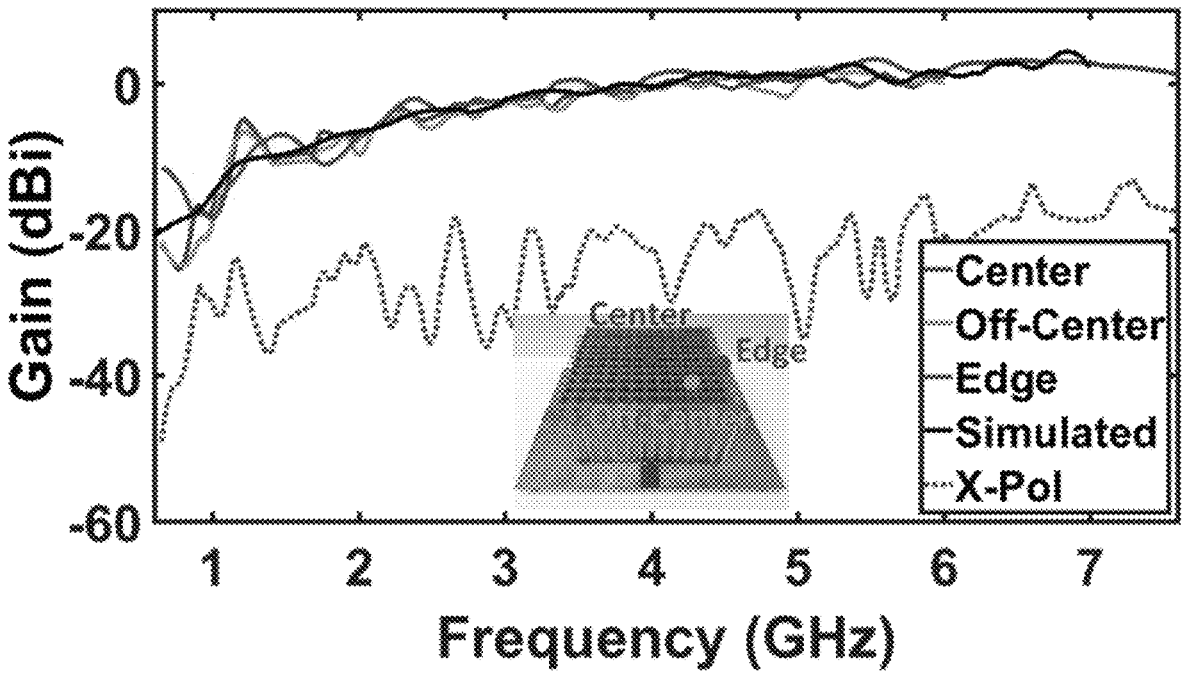

FIG. 17 is a plot of gain (in dBi) versus frequency (in GHz) measured for the center, off-center, and edge array elements of the TCDA depicted in FIG. 9, as well as simulated and cross-polarization (X-pol).

Figure 18:
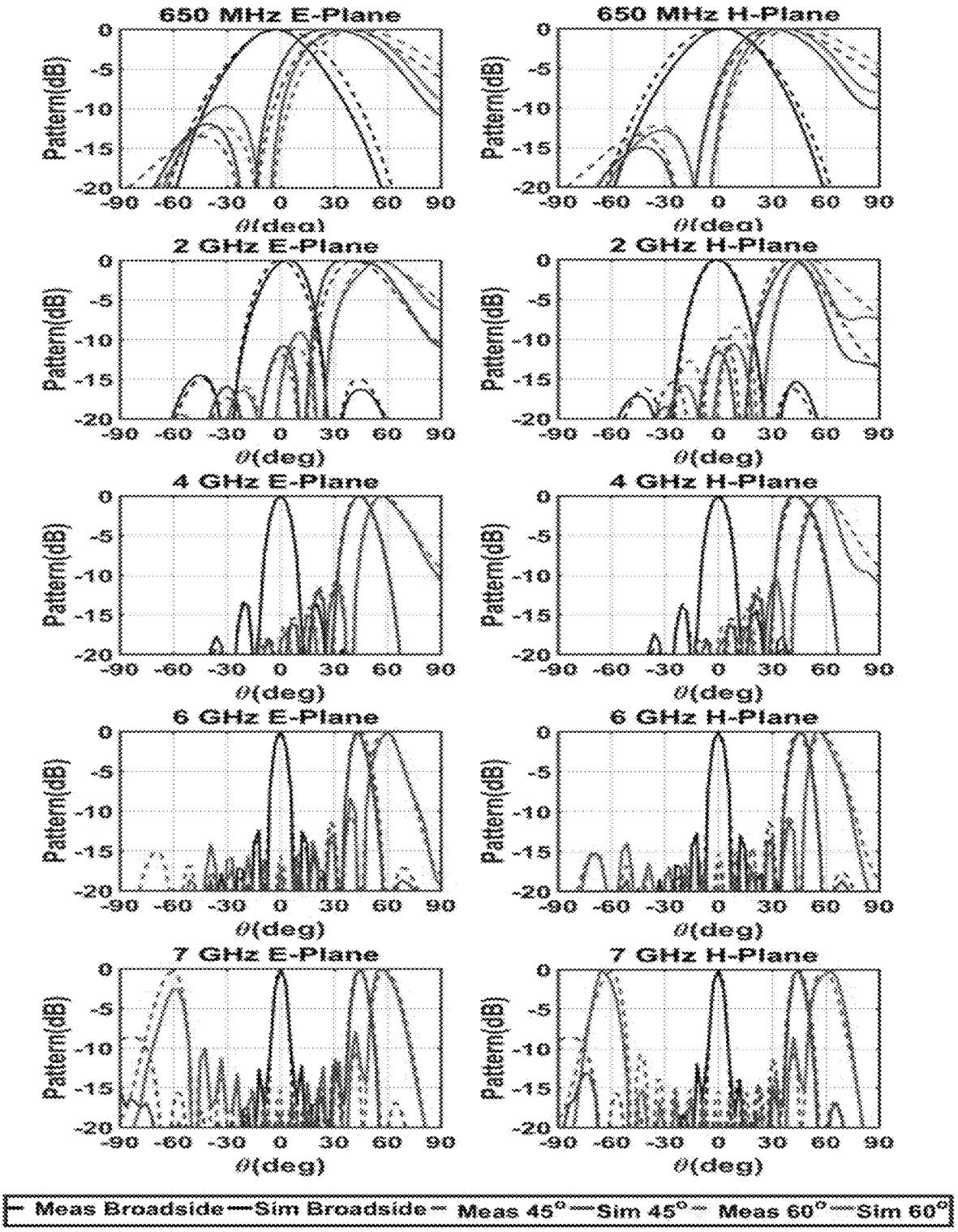

FIG. 18 shows lots of gain patterns (in dB) versus θ (in degrees) for E-plane (left column) and H-plane (right column) of a center array element of the TCDA depicted in FIG. 9, at frequencies of 650 MHz (first row), 2 GHz (second row), 4 GHz (third row), 6 GHz (fourth row), and 7 GHz (fifth row) using the active element pattern (AEP) method. Results for broadside (measured and simulated), a scan angle of 45° (measured and simulated), and a scan angle of 60° (measured and simulated) are shown. For each curve type, the dashed curve is for measured and the solid curve is for simulated; the measured and simulated agree well for each of broadside, 45°, and 60°. In each of the ten plots, the curve at 0 dB for θ=0° is for broadside (simulated), the curves (dashed-solid pair) that have the highest positive value of θ at which the gain pattern is 0 dB is for 60°, and the curves (dashed-solid pair) that have the second-highest positive value of θ at which the gain pattern is 0 dB is for 45°.

Figure 19:
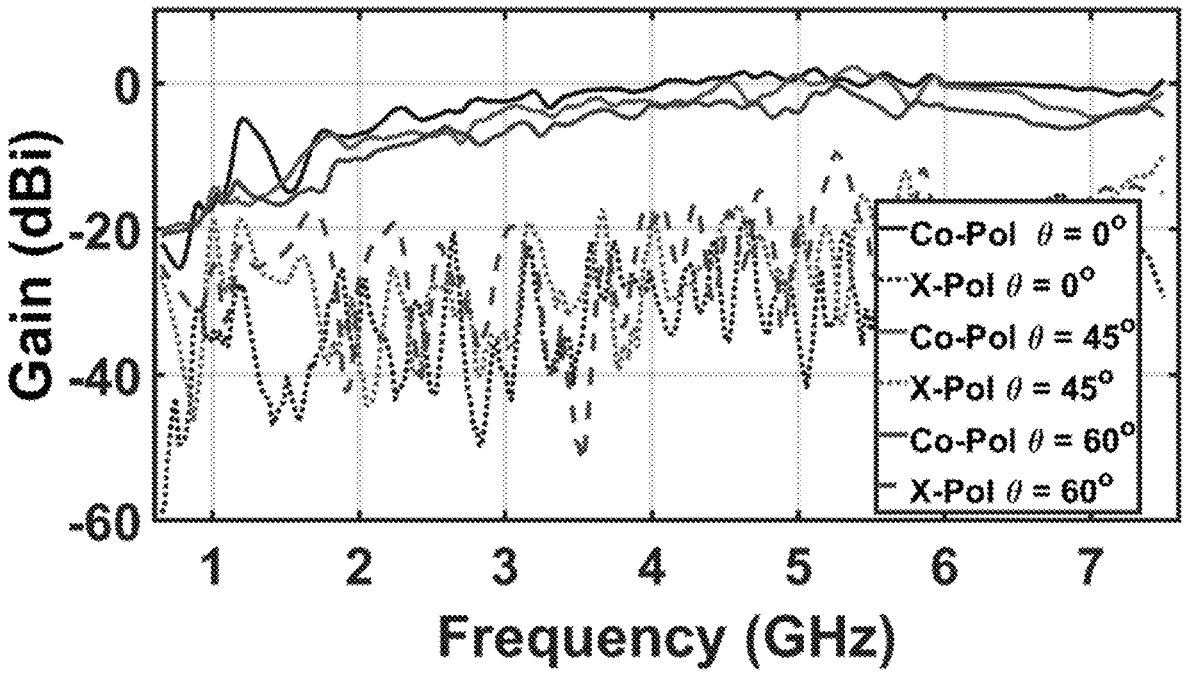

FIG. 19 is a plot of measured D-plane co-polarized (co-Pol) and cross-polarized (X-pol) gain (in dBi) versus frequency (in GHz) at θ=0°, 45°, and 60° cuts for a center array element of the TCDA depicted in FIG. 9. A polarization purity of 17 dB on average was achieved out to θ=+/−60°.

Figure 20A:
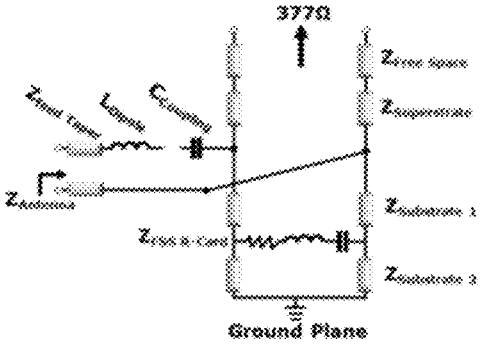
Figure 20B:
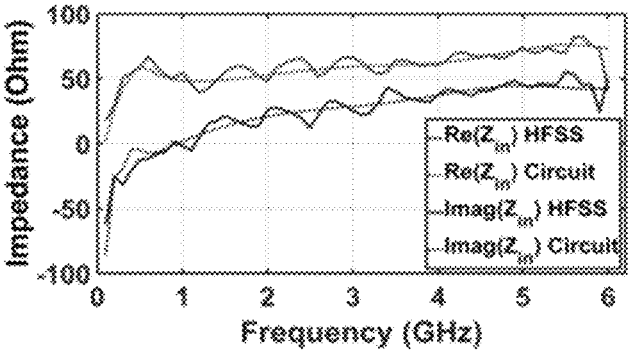

FIG. 20(*a*) is an equivalent circuit for the TCDA shown in FIGS. 1(*a*)-1(*c*).

FIG. 20(*b*) is a plot of impedance (in Ohm (Ω)) versus frequency (in GHz) showing impedance verification of the circuit model of FIG. 20(*a*) versus an ANSYS HFSS v.19 simulation. "Re" and "Imag" represent real and imaginary parts, respectively, of the impedance, with the real part being the higher curves for both HF SS and circuit model.

Figure 21:
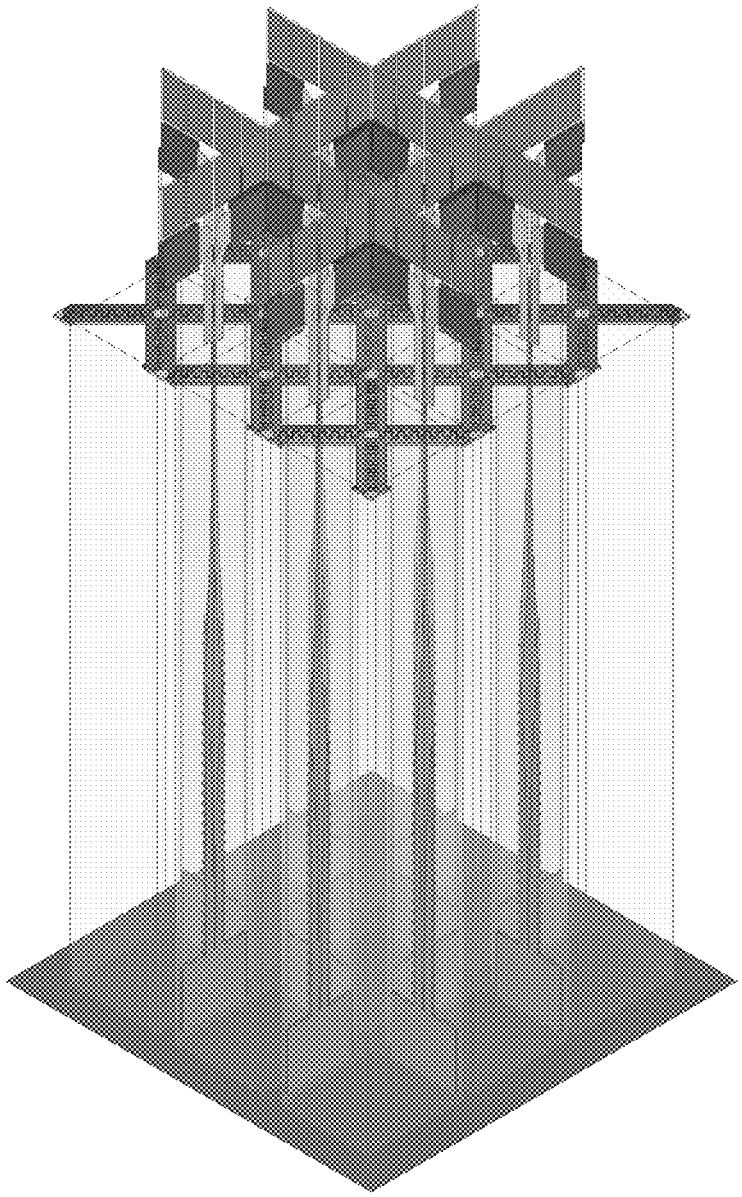

FIG. 21 is a schematic view of a TCDA with an FSS R-card, according to an embodiment of the subject invention. FIG. 20 shows a 4×4 array of a TCDA, which can either be the entire TCDA or in many cases a section of the entire TCDA.

Figure 22:
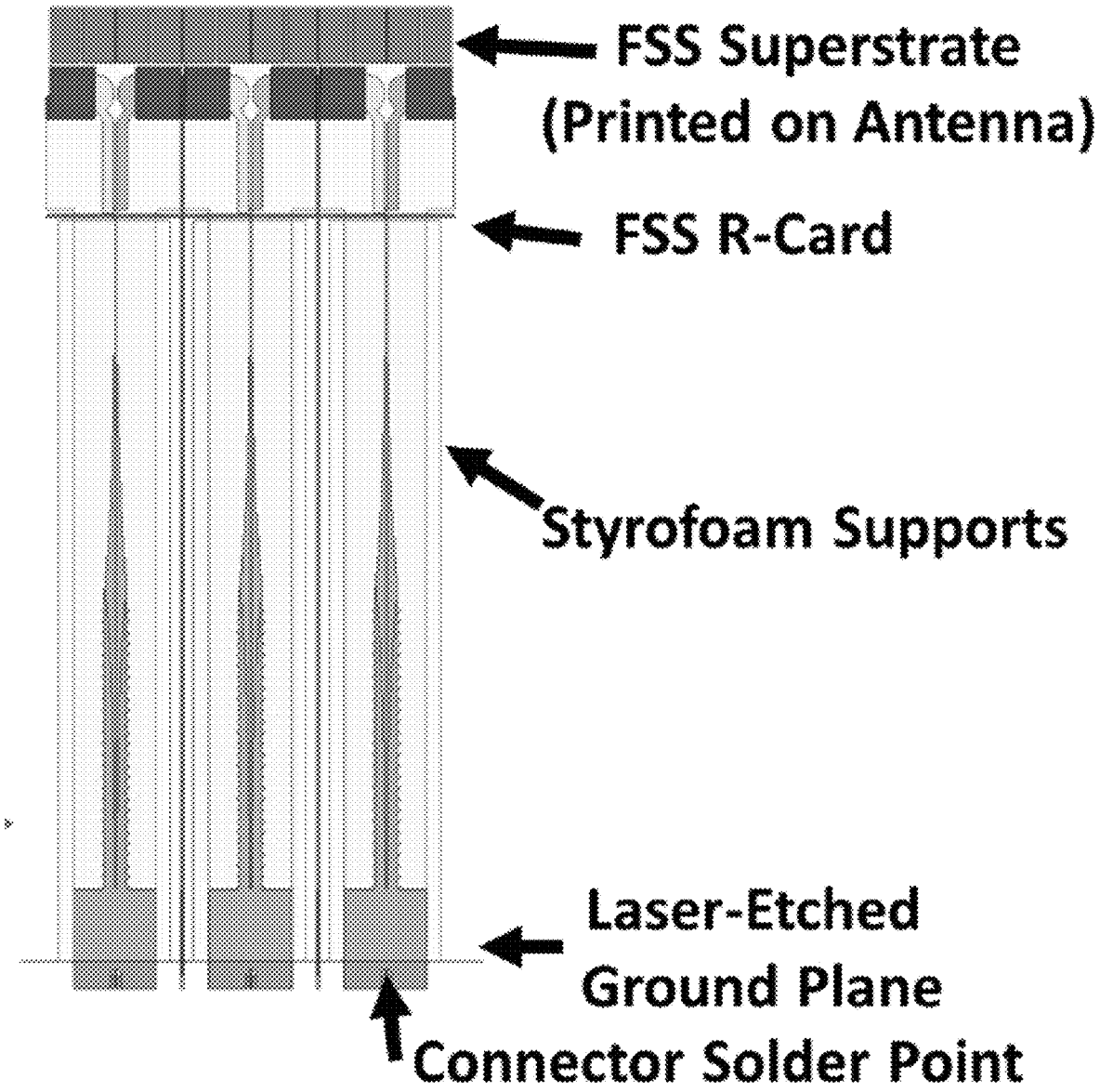

FIG. 22 is a side view of the TCDA shown in FIG. 21. Although FIG. 21 indicates certain portions are made with specific materials, these are listed for exemplary purposes only and should not be construed as limiting.

Figure 23:
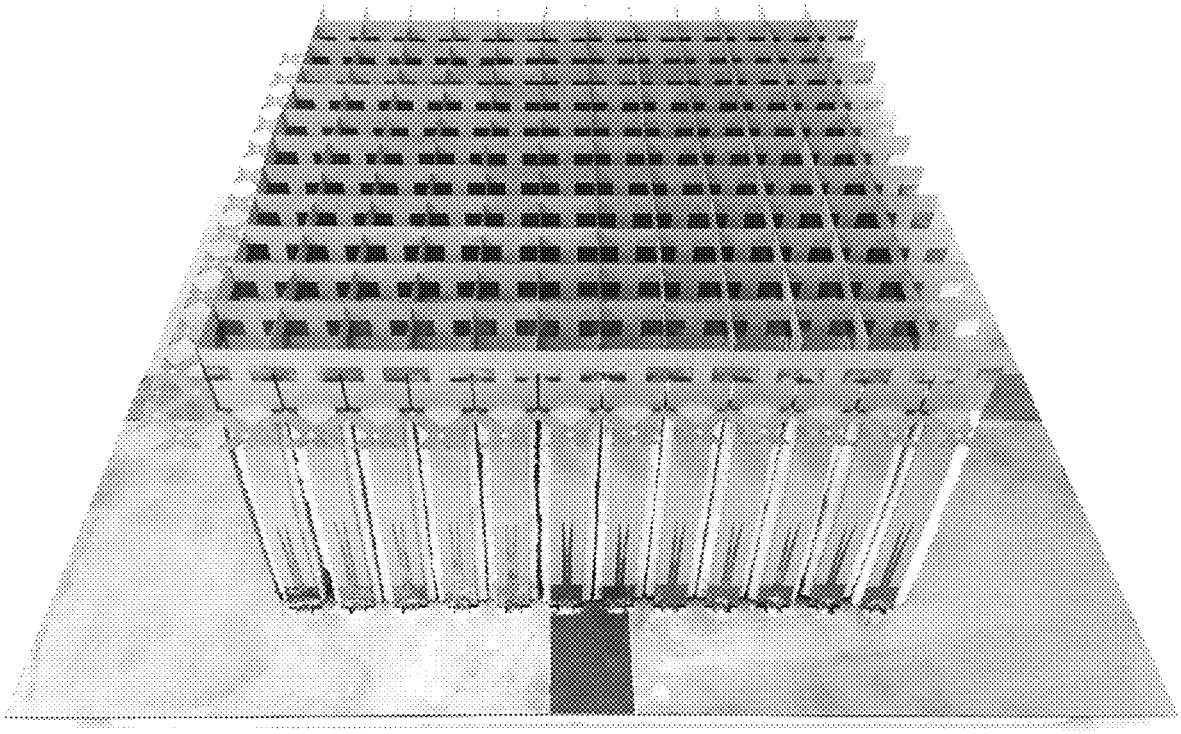

FIG. 23 is an image of the fabricated 12×12 array TCDA of FIG. 9, from a different angle.

Figure 24:
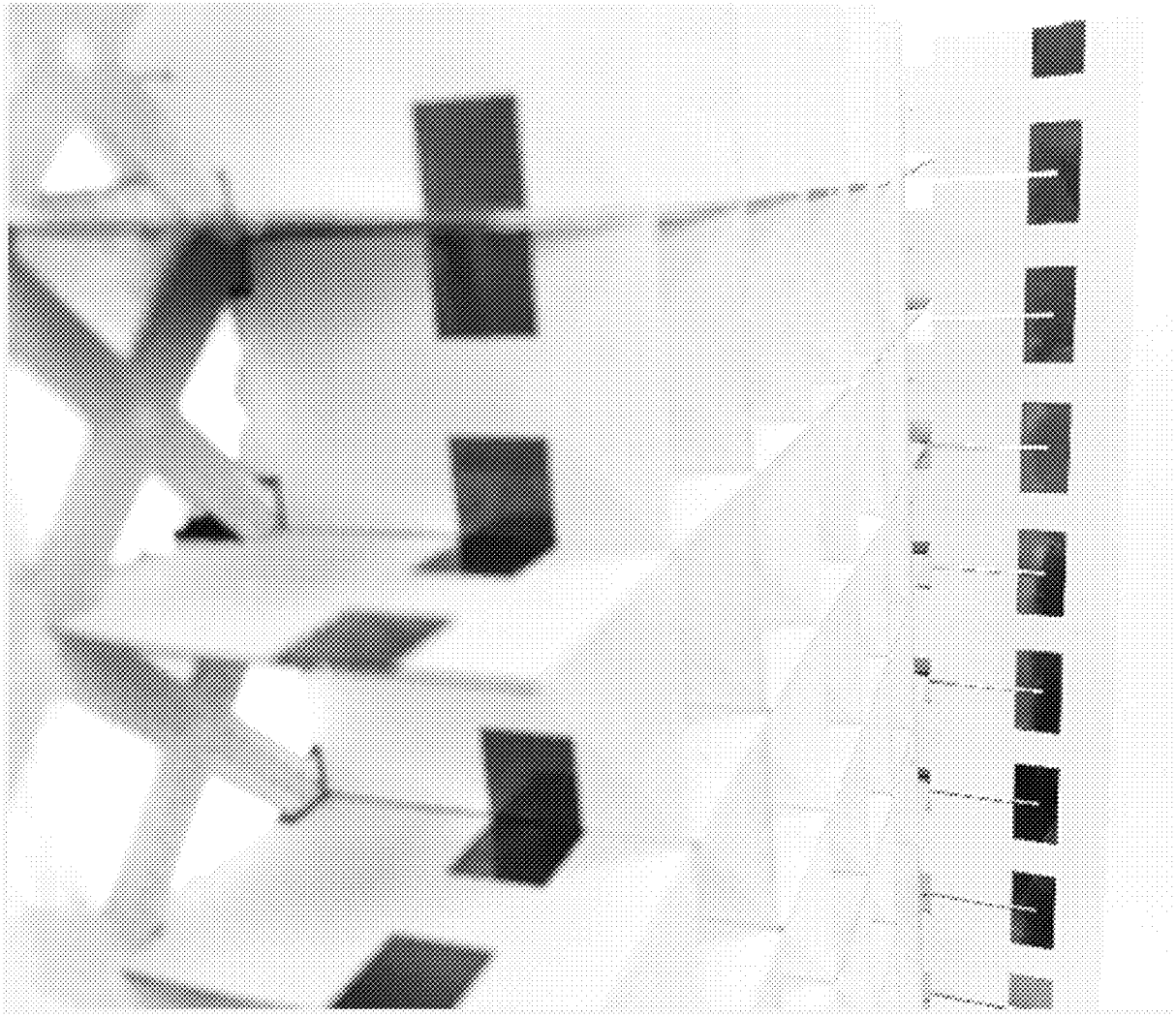

FIG. 24 is a close-up image of the top, taken at an angle, of the TCDA of FIGS. 9 and 23.

Figure 25:
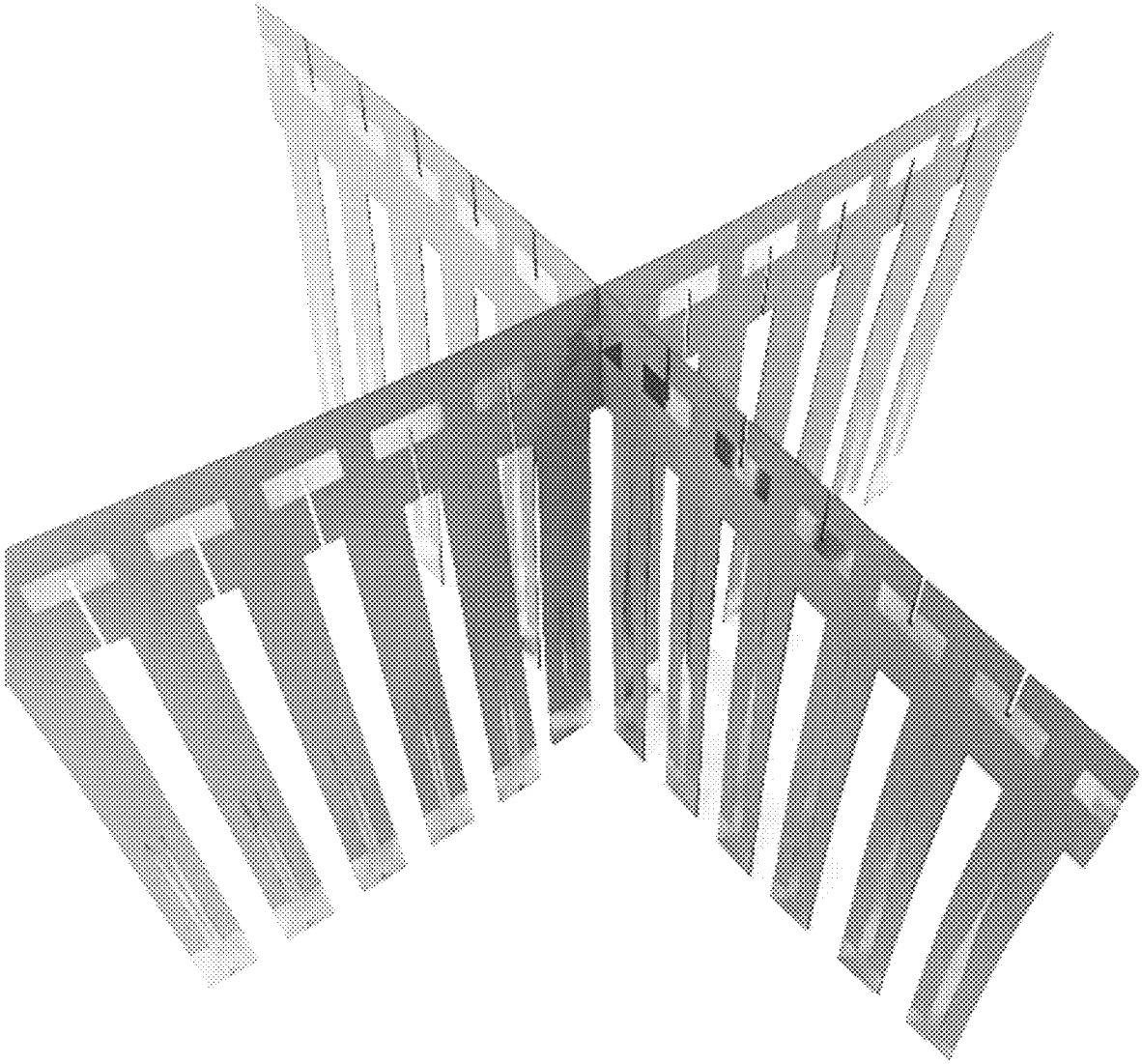

FIG. 25 is an image of antenna elements of the TCDA of FIGS. 9 and 23.

Figure 26:
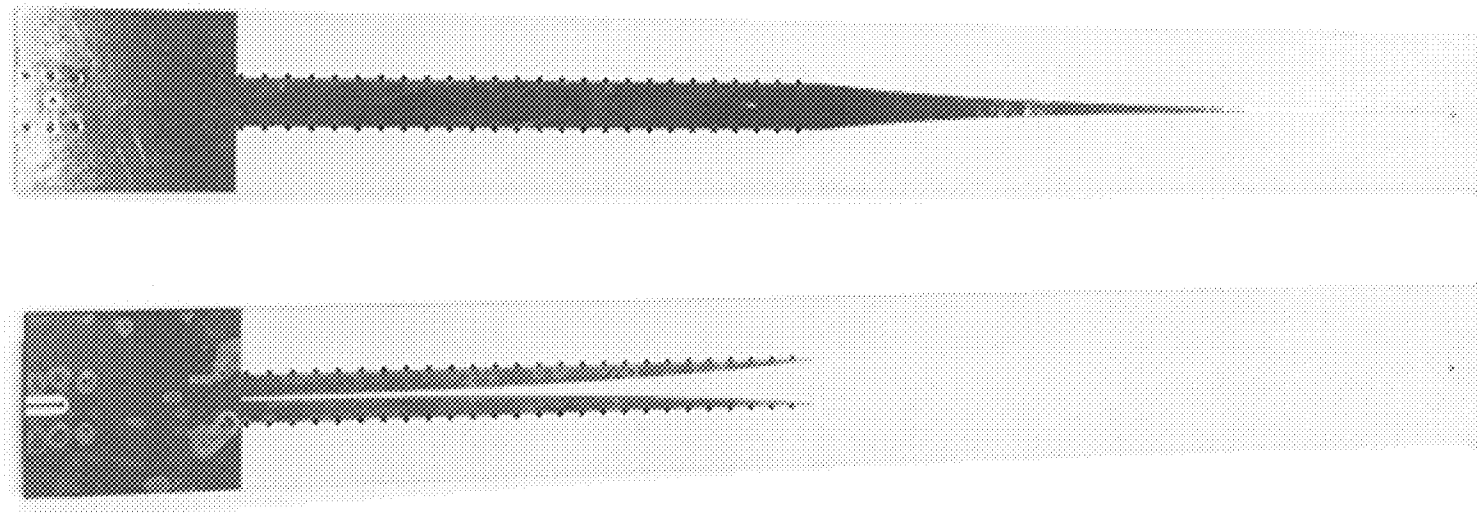

FIG. 26 is an image of a balun of the TCDA of FIGS. 9 and 23.

Figure 27:
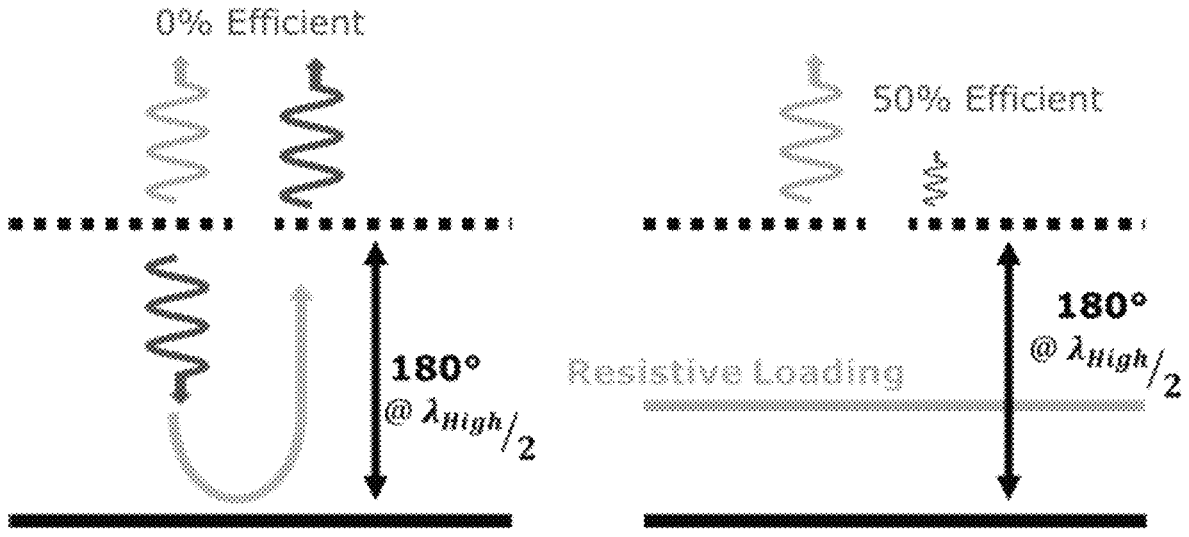

FIG. 27 is a schematic view showing the ground plane effect for antennas. The left side shows the ground plane reflected wave canceling the radiation, and the right side shows that resistive loading can help mitigate this issue.

DETAILED DESCRIPTION

Embodiments of the subject invention provide novel and advantageous antenna devices that include a frequency selective surface (FSS) resistive card (R-card) to suppress ground plane interference. The antenna device can include a tightly coupled dipole array (TCDA), and the FSS R-card can be, for example, a saw-tooth ring (see FIG. 4) that only attenuates the intended frequencies, thereby increasing total efficiency. The antenna device can be an extremely wide-band phased array with integrated feeding network and good spatial scanning (e.g., spatial scanning down to 60°). The antenna device can have a bandwidth of at least 50:1 (e.g., 58:1) together with the scanning capability down to 60° in both E- and H-planes, and the radiation efficiency can be at least 70% (e.g., at least 72% or at least 73%). The FSS R-card can provide an extremely wideband (EWB) impedance match.

Embodiments of the subject invention can include an EWB TCDA that is thin (e.g., thickness of the wavelength of operation divided by 13.5 ($\lambda_{low}$/13.5 thick at the lowest frequency of operation (e.g., 130 MHz))) (e.g., on the order of less than 200 millimeters (mm), such as 171 mm or less). The TCDA can achieve a contiguous broadside impedance bandwidth (VSWR<3) of at least 50:1 (e.g., 58:1) with an average radiation efficiency of at least 70% (e.g., at least 72%) across the band.

FIGS. 1(*a*), 1(*b*), 1(*c*), and 21 are schematic views of an antenna device including a TCDA, according to an embodiment of the subject invention. FIG. 22 shows a side view of FIGS. 1(*a*) and 21. Referring to FIGS. 1(*a*), 1(*b*), 1(*c*), 21, and 22, the antenna device can include an FSS R-card (e.g., an FSS superstrate) to achieve scanning down to 60° from broadside across the entire band. The element-to-element separation of the adjacent array elements can be as low as the wavelength of operation divided by 92 ($\lambda_{low}$/92 at the lowest frequency of operation (e.g., 130 MHz))) (e.g., on the order of less than 100 mm, such as 26 mm or less). The array elements can be periodically spaced at $\lambda_{high}$/2 apart (e.g., less than 250 mm), where $\lambda_{high}$ corresponds to the wavelength at the highest operational scan frequency (e.g., 6 GHz). A 58:1 broadside bandwidth can be achieved without grating lobes. The FSS R-card can be disposed within the substrate, and the FSS R-card can suppress or cancel the ground plane reflection. This effect is most advantageous when the distance between the array and the ground plane is a multiple of $\lambda_{high}$/2 across the band. The antenna device can include a wideband balun (see FIGS. 1(*c*), 22, and 26), and the balun can comprise an exponentially tapered stripline feed.

FIG. 20(*a*) is an equivalent circuit for the TCDA shown in FIGS. 1(*a*)-1(*c*), and FIG. 20(*b*) is a plot of impedance (in Ohm (a)) versus frequency (in GHz) showing impedance verification of the circuit model of FIG. 20(*a*) versus an ANSYS HFSS v.19 simulation.

In an embodiment, a dual-polarized TCDA can include an FSS superstrate, which can be metal (though embodiments are not limited thereto) for low-angle scanning. The array profile can be $\lambda_{low}$/13.5 thick, which is more than 3 times shorter than a 10:1 Vivaldi array with $\lambda_{high}$/2 spacing. The antenna device can be configured such that the cross-polarized dipole elements are not fed concentrically, but instead the feed cards can intersect at the ends of the dipoles (see FIG. 1(*b*)).

Related art TCDAs employ overlapping planar dipoles with each linear polarization printed on opposite sides of a substrate, but this would require soldering to any vertically-oriented stripline balun feed that may be present (and such a balun can be present in some embodiments of the subject invention). In contrast, embodiments of the subject invention can include a design printed coherently on feed boards (e.g., three-layer feed boards) to save fabrication and assembly time. The dipole arms can reside in a center layer, and the capacitive sheets can lie on respective outer layers of a three-layer feed board to create the coupling needed to achieve the current sheet effect. The FSS R-card serves to cancel the negative effects of periodic ground plane reflections (see also FIG. 27). The TCDA antenna device can achieve 58:1 broadside bandwidth and an average loss of only −1.42 dB across the band.

Figures 2A, 2B, 2C, 2D:
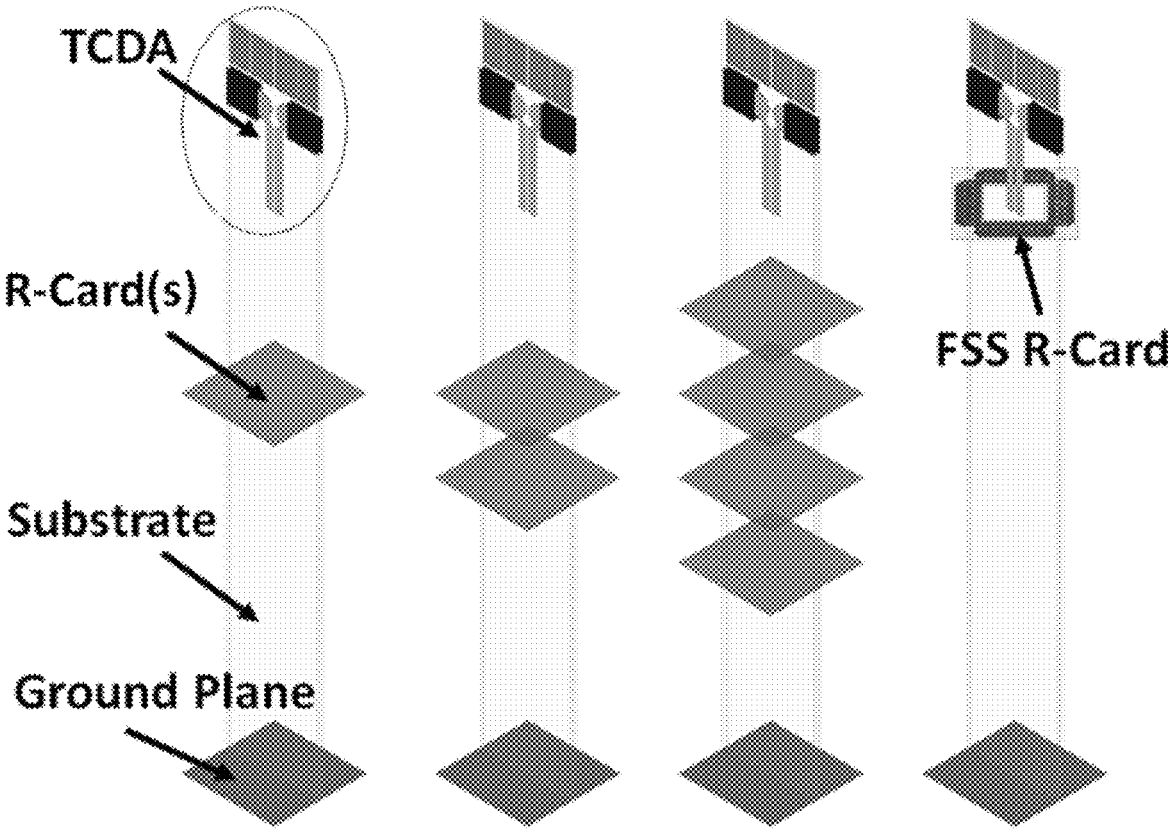
FIG. 2(*a*) shows a schematic view of a TCDA with a 1-layer R-card.

FIG. 4(*a*) is an overhead view of a section of an FSS R-card, according to an embodiment of the subject invention. Although certain materials and values are listed in FIG. 4(*a*), these are listed for exemplary purposes only and should not be construed as limiting. FIG. 4(*b*) is an overhead view showing an enlarged version of a portion of the FSS R-card shown in FIG. 4(*a*). Although certain dimensions are listed in FIG. 4(*b*), these are listed for exemplary purposes only and should not be construed as limiting. Referring to FIGS. 4(*a*) and 4(*b*), the FSS R-card can be placed within the substrate to extend the capabilities of the TCDA to an EWB, such as a 58:1 achievable impedance bandwidth. The FSS R-card can be frequency dependent and/or tuned for maximum radiation efficiency across the entire band. A stacked card implementation of 1, 2, and 4 cards was investigated, as shown in FIGS. 2(*a*)-2(*c*), respectively. The R-cards were optimized using a unit cell of periodic boundaries with an ideally fed dual polarized TCDA without the balun feed. The differential lumped port between the dipole terminals allowed for fast computational optimization of the designs. First, the $\lambda_{6\ GHz}$/2 ($\lambda_{high}$/2) dipoles were placed at a set height above the ground plane, to see the magnitude and phase of reflection coefficients of the dipoles in presence of a ground plane. As expected, the ground plane reflections appeared as a +180° phase shift that destructively canceled the upward radiating wave for an efficiency of 0%. To counter this ground plane reflection, the number, resistance value, and height of each R-card implementation was tuned to optimally reduce the magnitude of the ground reflections and steer the energy to a lower resistance in the superstrate, for >50% efficiency at these narrow bands. The 4-layer arrangement produced the desired bandwidth for the intended TCDA radiator, but with wideband losses over the whole of the band. Therefore, the FSS R-card in FIG. 2(*d*) was used to mimic the higher order effect of four stacked R-cards with minimal losses.

The FSS R-card can have a band-stop response with additional optimized teeth for a multi-notch filter behavior. Further, the resonant frequencies of the FSS R-card can be designed to cancel the negative effects of the ground reflections at periodic heights of Nλ/2 (where N is the number of corresponding periodic high frequency ground plane reflections). Doing so, the bandwidth is extended to greater than 50:1 (e.g., 58:1) with an average loss of less than 1.5 dB (e.g., less than 1.42 dB) over the band at broadside. The square loop's radius, line widths, and height above the ground plane were tuned as design variables to achieve the intended filtering response, and FIG. 4 depicts some exemplary dimensions that provided excellent performance. FIG. 3 is a plot of the frequency response of FSS R-card of FIG. 4, and FIG. 3 shows attenuated response only at the periodic frequencies that correspond to the cyclical ground plane short circuits (i.e., Nλ/2). The ring FSS R-card operates over a wider bandwidth due to its higher order response from the optimized gaps and teeth. The bandwidth of a resistive loaded TCDA can be even further improved by increasing the order of the FSS R-card with smaller loops to resolve higher frequency ground reflections. Though, the height of the dipole above the ground plane is a function of the lowest frequency of operation, while the highest frequency of operation determines grating lobes and array spacing. Therefore, as the lateral dimensions shrink and vertical dimensions stay constant the bottleneck of the design becomes mechanical considerations and fabrication tolerances.

To excite the TCDA (e.g., the 58:1 aperture), two baluns (FIG. 5(*b*) and FIG. 5(*c*)) were designed and evaluated against the Marchand balun shown in FIG. 5(*a*). In practice, the Marchand balun uses a series open stub and a parallel short stub, whose impedance and lengths are tuned to achieve a broadband match. This feeding network has a proven wideband performance through elimination of common mode currents across 14:1 bandwidths. However, as depicted in FIG. 5(*d*), the Marchand balun cannot perform over a 58:1 bandwidth. As an alternative, a co-planar waveguide (CPW) to co-planar stripline (CPS) balun was considered. This feed acted as an effective balun with cancellation of the common-mode currents across the entire bandwidth, but lacked the impedance transformation and transmission efficiency of the tapered balun. The tapered stripline balun has a stripline configuration of exponentially tapered feed and ground traces. This balun cancels common-mode currents while transferring the input impedance from 188 Ohms (Ω) at the dipole to 50Ω at the connector in a total aperture profile of only $\lambda_{low}/13.5$.

Antenna devices of embodiments of the subject invention can have EWB enabling multi-function operation and condensing the number of components needed for all these tasks, thereby reducing power, cost, and space by orders of magnitude. They can be capable of low angle scanning in both principle planes (E and H) down to 60° and can be manufactured through inexpensive well-known techniques while being compatible with off-the-shelf components. For example, they can be manufactured with printed circuit board (PCB) technology for low cost mass production, and the small form factor and compatibility with current and envisioned future technology makes the antenna device ideal for commercial, military, and scientific sectors.

Embodiments of the subject invention have a small volume and high performance design that can be integrated with wideband systems and future technologies for applications in commercial communications, military communications, radar, and remote sensing. An ultra-wideband array can replace several narrowband systems for orders of magnitude reduction in power, cost, and space. No related art antenna device can operate across a continuous >50:1 of bandwidth and scan down to 60° with an efficiency of at least 70% (or at least 73%) on average.

A greater understanding of the embodiments of the subject invention and of their many advantages may be had from the following examples, given by way of illustration. The following examples are illustrative of some of the methods, applications, embodiments, and variants of the present invention. They are, of course, not to be considered as limiting the invention. Numerous changes and modifications can be made with respect to the invention.

Example 1

An infinite array simulation was used to represent a 12×12 finite element array of the TCDA shown in FIGS. 1(*a*)-1(*c*) (FIG. 1(*a*) shows a 4×4 section of the 12×12 array) 1 using ANSYS HFSS v.19. The plane containing the direction of the current is denoted as the E plane, with the perpendicular plane denoted as the H plane. The infinite array VSWR for the principle planes, with scanning to 60° is shown versus frequency in FIG. 6. The array was designed for a VSWR<3 for 0.13 GHz to 6 GHz for an impedance bandwidth of 46:1 with scanning. A reduced performance in the low frequency H-plane VSWR is expected when scanning to low angles with dual-polarized planar arrays due to its 1/cos(θ) free space impedance, hence the mismatch around 2 GHz at 60°. The array was characterized by its near theoretical gain and average principle plane polarization purity of 40 dB as shown in FIG. 7. The co- and cross-polarized gains of the unit cell for the D-plane, with scanning to 60°, are shown versus frequency in FIG. 8. As expected, the diagonal plane (D-plane) cross-polarized gain level rises when scanning, but the EWB TCDA still exhibited greater than 20 dB cross-polarization suppression across the band. The simulated radiation efficiency of the infinite array unit cell was 72% on average, with the lowest efficiency of 50% in the narrowband of the first ground plane resonance around 1 GHz. This narrowband efficiency drop is due to the high magnitude of the reflection coefficient present at the first ground reflection, as shown in FIG. 3. This efficiency may be improved by further tuning the first resonance of the FSS R-card to have a lower magnitude response at the first ground plane resonance.

Example 2

A 12×12 dual-polarized TDCA was fabricated and tested. The TDCA included an FSS R-card and is shown in FIGS. 9, 10(*a*), 10(*b*), 11, 12(*a*), 12(*b*), and 23-26. The FSS metal superstrate was printed on the vertical antenna cards for optimized scanning performance. The antenna board was constructed from two layers of 10 mil (1 mil=0.001 inches) thick Rogers 3003 with $\varepsilon_r$=3.0. The fabricated ground board was milled from a metalized 60 mil FR4 board with cutouts for securing the antenna cards. A total of four ground plane sections were joined together with copper tape to form a lightweight, structurally stable and resonance free ground plane for testing the array.

The tolerances of commercial PCB manufacturing were constantly considered in the design process, where metal thickness and via misalignment result in a significant change from the ideal design. The design used 10 mil diameter vias and a minimum metal tolerance of 0.1524 mm (6 mil) in accordance with standard low-cost commercial PCB processes. To ensure structural stability, the fabricated dual-polarized array was constructed in an "egg-crate" arrangement with notches cut into the dielectric boards for an orthogonal fit between the layers. For ease of fabrication, the array was designed with no direct electrical connection or soldering required at the joints.

The fabricated FSS R-card included 25 Ω/square Omega-Ply material printed on a 20 mil thin FR4 substrate, with the details shown in FIGS. 4(*a*) and 4(*b*). An air gap was intentionally routed from the inner radius of the square loop to allow placement of the antenna cards through the FSS. Styrofoam supports were used to place the FSS R-card at the desired height of 134.5 mm above the ground plane. The FSS R-card was fabricated and placed in a symmetric orientation to the dipoles, to allow equal filtering response for both polarizations.

The tapered balun feed structure was fabricated alongside the tightly coupled dipoles and metallic FSS superstrate on a two dielectric stack-up, with the dimensions shown in FIG. 11 and Table 1. The stripline configuration included an exponentially tapered feed in the middle layer and tapered ground traces on the outer layers, for transferring the input impedance to 50Ω with complete cancellation of the common-mode currents. Vias with diameter of 10 mil and optimized pitch of 2 mm were used to create the tapered substrate integrated waveguide (SiW) to coupled line feed transition. One dipole arm was coplanar with the coupled line feed, and the second dipole arm was connected to the other coupled line trace by a via as shown in FIG. 11. A key-hole transiting was implemented to efficiently transfer the signal from an outer microstrip trace to the inner conductor of the stripline balun. The via placement and backside relief hole diameter is crucial to the impedance matching of this through-via transition.

The array was designed and fabricated using two layers of 10 mil thin Rogers 3003 substrate for low loss and low cost PCB fabrication. The electrical properties of Rogers 3003 (tan δ=0.001) help in reaching the arrays impressive efficiency over such a wide bandwidth. However, in practice the mechanical properties of this polytetrafluoroethylene (PTFE) material caused bending and bowing in some of the antenna cards, as seen in FIG. 12(*a*). These fabrication imperfections can result in inconsistent elements that reduce element-level coupling and impedance matching. Further, bending in the antenna cards can increase cross-polarized gain levels up to 30 dB for even 1° of misalignment. To reduce this effect, the 23 mm×23 mm×134.5 mm Styrofoam blocks placed in between the cards to set the FSS R-card height doubled as mechanical supports for the array. The array in FIG. 9 is shown without these Styrofoam blocks for clarity of the design. A TCDA could be implemented on a mechanically rigid substrate, such as the woven glass ceramic Rogers 4003 (though, the losses of the material (tan δ=0.0027) would have to be accounted for in the design).

TABLE I

DIMENSIONS (UNITS : MM) OF TAPERED BALUN IN FIG. 11

| A | B | C | D | E | F | G | H |
|---|---|---|---|---|---|---|---|
| 8.5 | 0.254 | 0.152 | 13.62 | 4 | 52.68 | 2 | 18 |
| I | J | K | L | M | N | O | P |
| 0.3 | 8 | .381 | 1.5 | 0.152 | 0.152 | 0.254 | 0.254 |

The fabricated 12×12 dual-polarized array in FIG. 9 was then tested. The active VSWR was computed in FIGS. 13 and 14 by adding the linear reflection coefficient of the element under test with the coupling terms from the surrounding elements of the 12×12 dual-polarized array. Referring to FIGS. 13 and 14, the measured VSWR of the central elements yielded a 58:1 impedance bandwidth with VSWR<3 from 0.13 GHz to 7.63 GHz at broadside, as simulations suggested. The VSWR in FIG. 14 rises to a maximum of 4.4 when scanning, as expected by the 1/cos(θ) free space impedance in the H-plane. The measured coupling terms are shown in FIG. 15, with the $S_{21}$ from a center element to a co-located center element, from a center element to an element 3 unit cells away, and another from the center to the edge of the array (6 unit cells away). As expected, coupling decreases with frequency and distance, with an average isolation of 22 dB over the band and a maximum of 11.6 dB for the co-located center element.

Multiple antenna elements were measured around the fabricated TCDA. Edge effects on peripheral array elements degrade low frequency performance due to a lack of mutual coupling. However, due to the nature of the resistive loading in the substrate these finite array effects are greatly reduced, with edge elements showing analogous VSWR and realized gain figures to the center and inner elements, as shown in FIGS. 16 and 17. The measured broadside gain of these embedded elements is plotted in FIG. 17 with comparison to the simulations. Gain measurements are only shown for frequencies greater than 650 MHz due to the low frequency cutoff of the reference horn. Likewise, the measured cross-polarized polarization purity is limited to 20 dB on average by the properties of the reference horn, with some bands showing up to 36 dB isolation. The measured gain patterns for a single center element are shown in FIG. 18. The patterns were extracted for scan angles of 45° and 60° from broadside scans using the Active Element Pattern method (see Pozar, "The active element pattern," IEEE Transactions on Antennas and Propagation, vol. 42, no. 8, pp. 1176-1178, Aug. 1994, ISSN: 0018-926X) to show the scanning capability of the array with the mathematical equivalent of a lossless beamformer up to the grating lobe frequency cutoff of 6 GHz. Referring to FIG. 18, it can be seen that the measured patterns are well correlated with simulations for the entire band. The 7 GHz plot in FIG. 18 was included to show the verification of broadside operation at the high band, with the expected grating lobes arising with the 45° and 60° scans. The measured D-plane co-polarized and cross-polarized gain according to Ludwig's 3rd definition (see Ludwig, "The definition of cross polarization," IEEE Transactions on Antennas and Propagation, vol. 21, no. 1, pp. 116-119, January 1973, ISSN: 0018-926X) are shown in FIG. 19. As stated, the cross-polarized gain levels are limited by the polarization purity of the reference horn used, but show more than 20 dB polarization purity at 0=±0°. To show the cross-polarization purity of the array, a D-plane 0=±45° and 0=±60° theta cut were included in FIG. 19 with a polarization purity of 17 dB on average out to 0=60°.

It should be understood that the examples and embodiments described herein are for illustrative purposes only and that various modifications or changes in light thereof will be suggested to persons skilled in the art and are to be included within the spirit and purview of this application.

All patents, patent applications, provisional applications, and publications referred to or cited herein are incorporated by reference in their entirety, including all figures and tables, to the extent they are not inconsistent with the explicit teachings of this specification.

What is claimed is:

1. An antenna device, comprising:

a ground plane;

a substrate disposed on the ground plane;

a plurality of antenna elements disposed on the substrate; and a frequency selective surface (FSS) resistive card (R-card) disposed between the ground plane and the plurality of antenna elements, the FSS R-card being a ring FSS R-card comprising a grid of square rings with a plurality of teeth and a plurality of air gaps within the grid, the plurality of teeth and the plurality of air gaps being configured such that the FSS R-card attenuates periodic frequencies that correspond to cyclical ground plane short circuits.

2. The antenna device according to claim 1, the FSS R-card being disposed in the substrate.

3. The antenna device according to claim 1, further comprising a balun electrically connected to the plurality of antenna elements.

4. The antenna device according to claim 3, the balun being a tapered stripline balun comprising an exponentially tapered stripline feed.

5. The antenna device according to claim 1, the plurality of antenna elements being a tightly coupled dipole array (TCDA).

6. The antenna device according to claim 1, each element of the TCDA having a width equal to $\lambda_{high}/2$, where $\lambda_{high}$ is a wavelength at a highest frequency of operation of the antenna device.

7. The antenna device according to claim 1, a diagonal length of each square ring being equal to $\lambda_{high}/2$, where $\lambda_{high}$ is a wavelength at a highest frequency of operation of the antenna device.

8. The antenna device according to claim 1, the FSS R-card being disposed horizontally such that the FSS R-card comprises an upper surface and a lower surface that are both parallel to an upper surface of the ground plane.

9. The antenna device according to claim 1, a distance between the ground plane and a top portion of the plurality of antenna elements being equal to $\lambda_{low}/13.5$, where $\lambda_{low}$ is a wavelength at a lowest frequency of operation of the antenna device.

10. The antenna device according to claim 1, the plurality of antenna elements comprising capacitive overlaps between adjacent antenna elements.

11. The antenna device according to claim 1, comprising exactly one FSS R-card.

12. An antenna device, comprising:

a ground plane;

a substrate disposed on the ground plane;

a tightly coupled dipole array (TCDA) comprising a plurality of antenna elements disposed on the substrate;

a frequency selective surface (FSS) resistive card (R-card) disposed between the ground plane and the plurality of antenna elements; and a balun electrically connected to the plurality of antenna elements, the balun being a tapered stripline balun comprising an exponentially tapered stripline feed, and the FSS R-card being a ring FSS R-card comprising a grid of square rings with a plurality of teeth and a plurality of air gaps within the grid, the plurality of teeth and the plurality of air gaps being configured such that the FSS R-card attenuates periodic frequencies that correspond to cyclical ground plane short circuits.

13. The antenna device according to claim 12, the FSS R-card being disposed in the substrate.

14. The antenna device according to claim 12, each element of the TCDA having a width equal to $\lambda_{high}/2$, where $\lambda_{high}$ is a wavelength at a highest frequency of operation of the antenna device.

15. The antenna device according to claim 12, the FSS R-card being disposed horizontally such that the FSS R-card comprises an upper surface and a lower surface that are both parallel to an upper surface of the ground plane.

16. The antenna device according to claim 12, a distance between the ground plane and a top portion of the plurality of antenna elements being equal to $\lambda_{low}/13.5$, where $\lambda_{low}$ is a wavelength at a lowest frequency of operation of the antenna device.

17. The antenna device according to claim 12, the plurality of antenna elements comprising capacitive overlaps between adjacent antenna elements.

18. The antenna device according to claim 12, comprising exactly one FSS R-card.

19. An antenna device, comprising:

a ground plane;

a substrate disposed on the ground plane;

a plurality of antenna elements disposed on the substrate;

a frequency selective surface (FSS) resistive card (R-card) disposed between the ground plane and the plurality of antenna elements; and a balun electrically connected to the plurality of antenna elements, the FSS R-card being a ring FSS R-card comprising a grid of square rings with a plurality of teeth and a plurality of air gaps within the grid, the plurality of teeth and the plurality of air gaps being configured such that the FSS R-card attenuates periodic frequencies that correspond to cyclical ground plane short circuits, the FSS R-card being disposed in the substrate, the balun being a tapered stripline balun comprising an exponentially tapered stripline feed, the plurality of antenna elements being a tightly coupled dipole array (TCDA), each element of the TCDA having a width equal to $\lambda_{high}/2$, where $\lambda_{high}$ is a wavelength at a highest frequency of operation of the antenna device, a diagonal length of each square ring being equal to $\lambda_{high}/2$, the FSS R-card being disposed horizontally such that the FSS R-card comprises an upper surface and a lower surface that are both parallel to an upper surface of the ground plane, a distance between the ground plane and a top portion of the plurality of antenna elements being equal to $\lambda_{low}/13.5$, where $\lambda_{low}$ is a wavelength at a lowest frequency of operation of the antenna device, the plurality of antenna elements comprising capacitive overlaps between adjacent antenna elements, and the antenna device comprising exactly one FSS R-card.

* * * * *